US008657701B2

(12) United States Patent
Boyd et al.

(10) Patent No.: US 8,657,701 B2
(45) Date of Patent: Feb. 25, 2014

(54) GOLF CLUB HEAD OR OTHER BALL STRIKING DEVICE HAVING STIFFENED FACE PORTION

(75) Inventors: Robert Boyd, Flower Mound, TX (US); John T. Stites, Weatherford, TX (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 13/549,014

(22) Filed: Jul. 13, 2012

(65) Prior Publication Data

US 2012/0283036 A1 Nov. 8, 2012

Related U.S. Application Data

(60) Continuation of application No. 13/295,832, filed on Nov. 14, 2011, now Pat. No. 8,226,498, which is a division of application No. 12/276,080, filed on Nov. 21, 2008, now Pat. No. 8,070,623.

(51) Int. Cl.
*A63B 53/04* (2006.01)

(52) U.S. Cl.
USPC ..... 473/329; 473/342; 473/346; 473/350

(58) Field of Classification Search
USPC ..... 473/324–350, 287–292; D21/747–753
See application file for complete search history.

(56) References Cited

U.S. PATENT DOCUMENTS

| | | | | |
|---|---|---|---|---|
| 2,087,685 | A | | 7/1937 | Hackney |
| 3,814,437 | A | | 6/1974 | Winquist |
| 4,438,931 | A | | 3/1984 | Motomiya |
| 4,511,145 | A | | 4/1985 | Schmidt |
| 4,681,321 | A | | 7/1987 | Chen et al. |
| 4,732,389 | A | | 3/1988 | Kobayashi |
| D318,703 | S | | 7/1991 | Shearer |
| 5,028,049 | A | * | 7/1991 | McKeighen ..... 473/345 |
| 5,067,715 | A | | 11/1991 | Schmidt et al. |
| 5,080,366 | A | | 1/1992 | Okumoto et al. |
| 5,295,689 | A | | 3/1994 | Lundberg |
| 5,377,985 | A | | 1/1995 | Ohnishi |
| 5,380,010 | A | | 1/1995 | Werner et al. |
| 5,451,058 | A | | 9/1995 | Price et al. |

(Continued)

FOREIGN PATENT DOCUMENTS

| | | |
|---|---|---|
| CN | 2431912 | 5/2001 |
| CN | 1602981 | 4/2005 |

(Continued)

OTHER PUBLICATIONS

International Search Report & Written Opinion from PCT Application No. PCT/US2009/064164 mailed Nov. 5, 2010.

(Continued)

*Primary Examiner* — Sebastiano Passaniti
(74) *Attorney, Agent, or Firm* — Banner & Witcoff, Ltd.

(57) ABSTRACT

A ball striking device, such as a golf club head, has a head that includes a face configured for striking a ball and a body connected to the face, the body being adapted for connection of a shaft proximate a heel thereof. The face includes one or more stiffening members or other structures on the inner surface of the face to provide locally increased stiffness to particular areas of the face. Certain stiffening members may provide greater stiffness than other stiffening members, allowing the face to be configured for areas of greatest stiffness and greatest COR tailored to common impact patterns.

23 Claims, 12 Drawing Sheets

(56) References Cited

U.S. PATENT DOCUMENTS

| | | | | |
|---|---|---|---|---|
| 5,464,211 | A | 11/1995 | Atkins, Sr. | |
| 5,547,427 | A | 8/1996 | Rigal et al. | |
| 5,570,886 | A | 11/1996 | Rigal et al. | |
| 5,586,947 | A * | 12/1996 | Hutin | 473/324 |
| 5,586,948 | A | 12/1996 | Mick | |
| 5,595,552 | A | 1/1997 | Wright et al. | |
| 5,669,829 | A | 9/1997 | Lin | |
| D386,550 | S | 11/1997 | Wright et al. | |
| D386,551 | S | 11/1997 | Solheim et al. | |
| D387,113 | S | 12/1997 | Burrows | |
| D387,405 | S | 12/1997 | Solheim et al. | |
| 5,709,615 | A | 1/1998 | Liang | |
| 5,711,722 | A | 1/1998 | Miyajima et al. | |
| 5,718,641 | A | 2/1998 | Lin | |
| D398,687 | S | 9/1998 | Miyajima et al. | |
| D400,945 | S | 11/1998 | Gilbert et al. | |
| 5,839,975 | A | 11/1998 | Lundberg | |
| 5,873,791 | A | 2/1999 | Allen | |
| 5,908,357 | A | 6/1999 | Hsieh | |
| 5,941,782 | A | 8/1999 | Cook | |
| 5,971,868 | A | 10/1999 | Kosmatka | |
| 5,997,415 | A | 12/1999 | Wood | |
| 6,007,432 | A | 12/1999 | Kosmatka | |
| 6,193,614 | B1 | 2/2001 | Sasamoto et al. | |
| 6,203,449 | B1 | 3/2001 | Kenmi | |
| 6,332,848 | B1 | 12/2001 | Long et al. | |
| 6,402,637 | B1 | 6/2002 | Sasamoto et al. | |
| 6,435,982 | B1 | 8/2002 | Galloway et al. | |
| 6,454,665 | B2 | 9/2002 | Antonious | |
| 6,482,107 | B1 | 11/2002 | Urbanski et al. | |
| 6,558,271 | B1 | 5/2003 | Beach et al. | |
| 6,605,007 | B1 | 8/2003 | Bissonnette et al. | |
| 6,641,490 | B2 | 11/2003 | Ellemor | |
| 6,652,391 | B1 * | 11/2003 | Kubica et al. | 473/345 |
| 6,780,123 | B2 | 8/2004 | Hasebe | |
| 6,800,038 | B2 | 10/2004 | Willett et al. | |
| 6,800,039 | B1 | 10/2004 | Tseng | |
| 6,840,872 | B2 | 1/2005 | Yoneyama | |
| 6,899,638 | B2 | 5/2005 | Iwata et al. | |
| 6,926,618 | B2 | 8/2005 | Sanchez et al. | |
| 6,960,142 | B2 | 11/2005 | Bissonnette et al. | |
| 6,994,635 | B2 | 2/2006 | Poynor | |
| 7,018,303 | B2 | 3/2006 | Yamamoto | |
| 7,041,003 | B2 | 5/2006 | Bissonnette et al. | |
| 7,056,229 | B2 | 6/2006 | Chen | |
| 7,137,907 | B2 | 11/2006 | Gibbs et al. | |
| 7,140,975 | B2 | 11/2006 | Bissonnette et al. | |
| 7,140,977 | B2 | 11/2006 | Atkins, Sr. | |
| 7,169,059 | B2 * | 1/2007 | Rice et al. | 473/329 |
| 7,192,364 | B2 | 3/2007 | Long | |
| 7,207,898 | B2 | 4/2007 | Rice et al. | |
| 7,247,104 | B2 | 7/2007 | Poynor | |
| 7,258,631 | B2 | 8/2007 | Galloway et al. | |
| 7,261,643 | B2 | 8/2007 | Rice et al. | |
| 7,387,579 | B2 | 6/2008 | Lin et al. | |
| 7,442,132 | B2 | 10/2008 | Nishio | |
| 7,494,426 | B2 | 2/2009 | Nishio et al. | |
| 7,575,524 | B2 | 8/2009 | Willett et al. | |
| 7,618,331 | B2 | 11/2009 | Hirano | |
| 8,012,041 | B2 * | 9/2011 | Gibbs et al. | 473/329 |
| 2001/0051548 | A1 * | 12/2001 | Iwata et al. | 473/329 |
| 2003/0190975 | A1 | 10/2003 | Fagot | |
| 2004/0018890 | A1 | 1/2004 | Stites et al. | |
| 2004/0219991 | A1 | 11/2004 | Suprock et al. | |
| 2005/0032586 | A1 | 2/2005 | Willett et al. | |
| 2005/0101407 | A1 * | 5/2005 | Hirano | 473/342 |
| 2005/0192118 | A1 | 9/2005 | Rice et al. | |
| 2006/0019770 | A1 | 1/2006 | Meyer et al. | |
| 2006/0046868 | A1 | 3/2006 | Murphy | |
| 2006/0068932 | A1 | 3/2006 | Rice et al. | |
| 2006/0073908 | A1 | 4/2006 | Tavares et al. | |
| 2006/0094531 | A1 | 5/2006 | Bissonnette et al. | |
| 2006/0111201 | A1 | 5/2006 | Nishio et al. | |
| 2006/0194644 | A1 | 8/2006 | Nishio | |
| 2007/0015601 | A1 | 1/2007 | Tsunoda et al. | |
| 2007/0155538 | A1 | 7/2007 | Rice et al. | |
| 2008/0015047 | A1 | 1/2008 | Rice et al. | |
| 2008/0032817 | A1 | 2/2008 | Lo | |
| 2008/0064523 | A1 | 3/2008 | Chen | |
| 2008/0125244 | A1 | 5/2008 | Meyer et al. | |
| 2008/0125246 | A1 | 5/2008 | Matsunaga | |
| 2008/0248896 | A1 | 10/2008 | Hirano | |
| 2010/0029402 | A1 | 2/2010 | Noble et al. | |

FOREIGN PATENT DOCUMENTS

| | | |
|---|---|---|
| JP | H8-243195 | 9/1996 |
| JP | 2980002 | 2/1997 |
| JP | H9-135932 | 5/1997 |
| JP | 3216041 | 7/1997 |
| JP | H9-239074 | 9/1997 |
| JP | H9-239075 | 9/1997 |
| JP | H9-299521 | 11/1997 |
| JP | 2000-126340 | 5/2000 |
| JP | 2001-9069 | 1/2001 |
| JP | 2001-293113 | 10/2001 |
| JP | 2002-165905 | 6/2002 |
| JP | 2002320692 | 11/2002 |
| JP | 2003180887 | 7/2003 |
| JP | 2003-290398 | 10/2003 |
| JP | 2005-253973 | 9/2005 |
| JP | 2006-175135 | 7/2006 |
| JP | 2008-036050 | 2/2008 |
| JP | 2008-515560 | 5/2008 |
| JP | 2008-237689 | 10/2008 |
| WO | 2008093710 | 7/2008 |

OTHER PUBLICATIONS

Third-Party Submission of Information dated Mar. 1, 2013 for JP Application No. 2011-537510.

CN Office Action dated Feb. 20, 2013, for application No. 200980146633.0.

English translation of JP Notice of Rejection dated Jun. 19, 2013, for JP Application No. 2011-537510.

EP Communication dated Dec. 9, 2013, for EP Application No. 09756099.9.

* cited by examiner

GOLF CLUB HEAD OR OTHER BALL STRIKING DEVICE HAVING STIFFENED FACE PORTION

CROSS-REFERENCE TO RELATED APPLICATIONS

This application is a continuation of copending U.S. patent application Ser. No. 13/295,832, filed Nov. 14, 2011, which application was a divisional of U.S. patent application Ser. No. 12/276,080, filed Nov. 21, 2008, and issued as U.S. Pat. No. 8,070,623 on Dec. 6, 2011, which applications and patent are incorporated by reference herein and made part hereof in their entireties.

TECHNICAL FIELD

The invention relates generally to ball striking devices, such as golf clubs and golf club heads, having a stiffened portion on the ball striking face thereof. Certain aspects of this invention relate to golf club heads having one or more stiffening members extending rearward from an inner surface of the face.

BACKGROUND OF THE INVENTION

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golfs popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. To reliably propel a golf ball straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from squared contact and/or is located away from the club's desired ball contact location, even by a relatively minor amount, also can launch the golf ball in the wrong direction, often with undesired hook or slice spin, and/or can rob the shot of distance. Accordingly, club head features that can help a user keep the club face square with the ball would tend to help the ball fly straighter and truer, in the desired direction, and often with improved and/or reliable distance.

Like other golf clubs, drivers and other "woods" also must make square contact with the golf ball, in the desired direction or path, in order to produce straight and true shots in the desired direction. Even small deviations from squareness between the club head and the golf ball at the point of contact can cause inaccuracy. Because drivers and other wood-type golf clubs typically launch the ball over greater distances than other clubs, these inaccuracies can be exaggerated.

Many off-center golf hits are caused by common errors in swinging the golf club that are committed repeatedly by the golfer, and which may be similarly committed by many other golfers. As a result, patterns can often be detected, where a large percentage of off-center hits occur in certain areas of the club face. For example, one such pattern that has been detected is that many high handicap golfers tend to hit the ball on the low-heel area of the club face and/or on the high-toe area of the club face. Other golfers may tend to miss the desired or optimal contact point in other areas of the club face. Because golf clubs typically are designed to contact the ball at or around the center of the face, such off-center hits may result in less energy being transferred to the ball, decreasing the distance of the shot. The energy or velocity transferred to the ball by a golf club also may be related, at least in part, to the flexibility of the club face at the point of contact, and can be expressed using a measurement called "coefficient of restitution" (or "COR"). The maximum COR for golf club heads is currently limited by the USGA at 0.83. Accordingly, a need exists to customize or adjust the local flexibility of a golf club face to provide maximized COR in the areas of the face where off-center hits tend to occur most, without exceeding current COR limitations.

The present devices and methods are provided to address the problems discussed above and other problems, and to provide advantages and aspects not provided by prior ball striking devices of this type. A full discussion of the features and advantages of the present invention is deferred to the following detailed description.

SUMMARY OF THE INVENTION

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to ball striking devices, such as golf clubs, with a head that includes a face configured for striking a ball and a body connected to the face, the body being adapted for connection of a shaft proximate a heel thereof. Various example structures of faces described herein include one or more stiffening members or other structures on the inner surface of the face to provide locally increased stiffness to particular areas of the face. The faces of the golf club head structures may be formed to include targeted regions of increased stiffness (e.g., in the upper heel and/or lower toe quadrants), which leaves other, targeted regions of the face to have increased flexibility as compared to the stiffened regions. By locating the targeted regions of increased face flexibility at locations on a face where a golfer tends to hit the ball (e.g., high handicappers, as noted above, tend to hit balls in the lower heel or upper toe regions of the club face), the golf shot may experience increased "kick" off the face on off-center hits (provided the off-center hits impact the face at the locations of increased flexibility and at a sufficient velocity), e.g., due to the increased COR response at these off-center locations. While increasing the COR response at some off-center locations, the regions of increased stiffness may be used to control the overall club head's COR response and to assure that the COR of the club head remains within the constraints of the Rules of Golf.

According to one aspect, the face includes a first stiffening member extending rearward from its inner surface, a longitudinal center line of the first stiffening member extending between a first point and a second point. The first point is positioned in an upper heel quadrant of the face, and the second point is positioned in a lower toe quadrant of the face. Alternatively, the first and second points may be positioned such that the longitudinal center line of the first stiffening member extends in a direction from the upper heel quadrant toward the lower toe quadrant. The first stiffening member provides locally increased stiffness to an area of the face between the first point and the second point. Additionally, one or more secondary stiffening members may be provided that extend rearward from the inner surface of the face and provide locally increased stiffness to one or more other areas of the face. The first stiffening member may provide a greater degree of stiffness to the face relative to the secondary stiffening member(s). In some example structures, the secondary stiffening members can be arranged in one or more radiating formations.

According to another aspect of the invention, the face includes a stiffening member extending rearward from its inner surface, wherein the stiffening member includes a central longitudinal axis extending between a first point and a second point. The first point is located in an upper heel quadrant of the face, and the second point is located in a lower toe quadrant of the face. Alternatively, the first and second points may be positioned such that the longitudinal center line of the first stiffening member extends in a direction from the upper heel quadrant toward the lower toe quadrant. The stiffening member of this example structure has a width that is greater at the first point and at the second point than its width at the intermediate and central area thereof. In some example structures, the stiffening member is defined on opposed sides by concave curvilinear edges tapering or curving inward toward the center (i.e., toward the stiffening member's longitudinal axis). In other example structures, the stiffening member is defined by two curvilinear ribs diverging proximate the first point and the second point and converging at the center.

According to still another aspect of the invention, the face includes a stiffening member extending rearward from its inner surface, wherein the stiffening member includes a central longitudinal axis extending between a first point and a second point. The first point is located in an upper heel quadrant of the face, and the second point is located in a lower toe quadrant of the face. Alternatively, the first and second points may be positioned such that the longitudinal center line of the first stiffening member extends in a direction from the upper heel quadrant toward the lower toe quadrant. The stiffening member provides areas of locally increased stiffness to the face proximate the first point and the second point that are larger than the area of locally increased stiffness provided proximate the center of the stiffening member.

According to a further aspect of the invention, the face has a first stiffening member extending rearward from its inner surface, providing locally increased stiffness to areas of the face. The first stiffening member extends across the inner surface of the face such that a majority of the first stiffening member is located in the upper heel quadrant and the lower toe quadrant of the face. A plurality of second stiffening members may extend rearward from the inner surface of the face and also provide locally increased stiffness to areas of the face. In at least some example structures, a majority of the second stiffening members will be distributed in the upper toe quadrant and the lower heel quadrant of the face. As described above, in some example structures, the second stiffening members can be formed into one or more radiating formations, which may have central points in the high-toe and low-heel areas of the face (e.g., in the upper toe and lower heel quadrants of the face).

According to still further aspects of the invention, the face includes a stiffening member extending rearward from its inner surface, wherein the stiffening member includes a central longitudinal axis extending between a first point and a second point and across the center of the face. The first point is positioned proximate one edge of the face, and the second point is positioned proximate a second edge of the face substantially opposite the first point (e.g., from the upper heel corner to the lower toe corner). The inner surface of the face may have concave portions located on opposite sides of the stiffening member, and the concave portions each may have a concave thickness profile, having a face thickness that is greatest proximate the first point and the second point and lowest proximate the midpoint between the first point and the second point. In some example structures, the stiffening member may have a convex thickness profile, having a face thickness that is lowest proximate the first point and the second point and greatest proximate the midpoint.

According to yet further aspects of the invention, a plurality of stiffening members extending rearward from an inner surface of the face provide locally increased stiffness to the face. These stiffening members may be arranged to create at least two radiating formations, such that the stiffening members of each radiating formation radiate from a central point spaced from a center point of the face (e.g., spaced from the geometric center of the face).

According to additional aspects of the invention, the face may have a textured or toothed structure distributed across a majority of its inner surface. The toothed structure may include at least one row of indents extending across at least a portion of the inner surface. In one example structure, the toothed structure is formed in a two-dimensional grid structure, having a plurality of rows and columns of indents extending across at least a portion of the inner surface. In another example structure, the two-dimensional grid structure further includes a plurality of substantially linear horizontal and vertical ribs separating the indents, the ribs being raised with respect to the indents. The indents may have an inverted pyramidal shape.

According to still additional aspects of the invention, the face has a stiffening member extending rearward from its inner surface such that a central longitudinal axis of the stiffening member extends from a first contact point to a second contact point. The stiffening member of this example structure has at least two legs extending from the face and extending substantially perpendicular to the face at the first and second contact points and an arm extending between the legs, the arm being spaced from the inner surface of the face. The stiffening member provides locally increased stiffness to the face such that areas of the face surrounding the first and second contact points have locally greater stiffness relative to other areas of the face spaced from the contact points. In various example structures, the stiffening member may be oriented to extend in the high-heel to low-toe direction or the high-toe to low-heel direction (e.g., in a direction from the upper heel quadrant toward the lower toe quadrant or from the lower heel quadrant toward the upper toe quadrant, etc.), or the stiffening member may have a Y-shaped structure.

Another aspect of this invention relates to golf club heads including: (a) a face configured for striking a ball with an outer surface thereof; (b) a body connected to the face, the body adapted for connection of a shaft proximate a heel of the body and having a toe opposite the heel; and (c) an elongated stiffening member extending rearward from an inner surface of the face and extending across the inner surface of the face such that a central longitudinal axis of the stiffening member extends between a first point and a second point. In this example structure, the first point is positioned in or toward an upper heel quadrant of the face (as compared to the second point), and the second point is positioned in or toward the lower toe quadrant of the face (as compared to the first point), and the stiffening member includes an annular ring (e.g., round, elliptical, polygon, or oval shaped, etc.) surrounding an enclosed internal area, wherein the annular ring is thicker than the enclosed internal area. The stiffening member further may include a sloped transition region extending between the annular ring and the enclosed internal area and/or a sloped transition region extending between the annular ring and an area external to the annular ring (in such structures, the enclosed internal area may be thicker than the area external to the annular ring).

Still another aspect of this invention relates to golf club heads including: (a) a face configured for striking a ball with an outer surface thereof; (b) a body connected to the face, the body adapted for connection of a shaft proximate a heel of the body and having a toe opposite the heel; (c) a first stiffening member extending rearward from an inner surface of the face and extending across the inner surface of the face from a first location to a second location, the first location positioned in or toward an upper heel quadrant of the face (as compared to the second location), and the second location is positioned in or toward the lower toe quadrant of the face (as compared to the first location), the first stiffening member providing locally increased stiffness to the face, and wherein the first stiffening member includes a curved surface that faces the heel; and (d) a second stiffening member extending rearward from the inner surface of the face and extending across the inner surface of the face from a third location to a fourth location, the third location positioned in or toward an upper heel quadrant of the face (as compared to the fourth location), and wherein the second stiffening member includes a curved surface that faces the toe. Optionally, the fourth location may be in or toward the lower heel or lower toe quadrants of the face (as compared to the third location). The curved surfaces of the first and second stiffening members may face one another to define an internal area between the stiffening members. Additionally, the stiffening members may include sloped transition regions extending from their top surfaces to this internal area, and/or sloped transition regions extending from their top surfaces to areas external to the stiffening members and external to the internal area. Furthermore, if desired, the stiffening members may be mirror images of one another.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
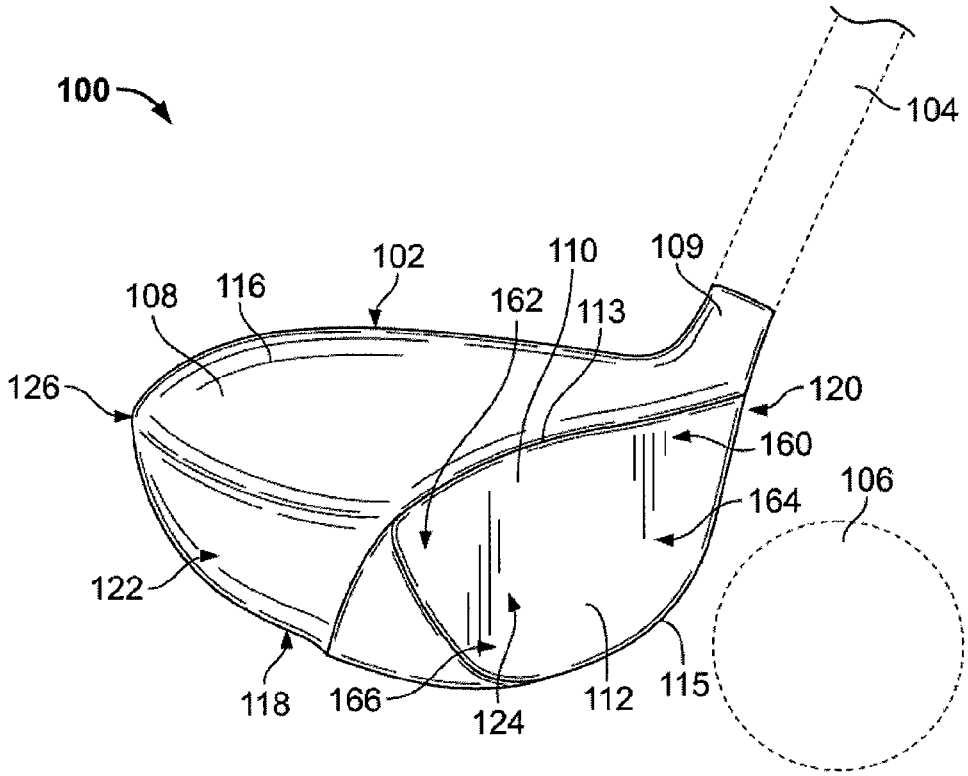
FIG. 1 is a perspective view of one embodiment of a head of a ball striking device according to the present invention, shown with a ball.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," "primary," "secondary," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like. In many bonds made by "integral joining techniques," separation of the joined pieces cannot be accomplished without structural damage thereto.

"Transverse" is not limited to perpendicular or generally perpendicular intersections, and refers broadly to a variety of angled intersections.

In general, aspects of this invention relate to ball striking devices, such as golf club heads, golf clubs, putter heads, putters, and the like. Such ball striking devices, according to at least some examples of the invention, may include a ball striking head and a ball striking surface. In the case of a golf club, the ball striking surface may constitute a substantially flat surface on one face of the ball striking head, although some curvature may be provided (e.g., "bulge" or "roll" characteristics). Some more specific aspects of this invention relate to wood-type golf clubs and golf club heads, including drivers, fairway woods, wood-type hybrid clubs, and the like, although aspects of this invention also may be practiced on irons, iron-type hybrid clubs, and the like, if desired.

According to various aspects of this invention, the ball striking device may be formed of one or more of a variety of materials, such as metals (including metal alloys), ceramics, polymers, composites, fiber-reinforced composites, and wood, and the devices may be formed in one of a variety of configurations, without departing from the scope of the invention. In one embodiment, some or all components of the head, including the face and at least a portion of the body of the head, are made of metal materials. It is understood that the head also may contain components made of several different materials. Additionally, the components may be formed by various forming methods. For example, metal components (such as titanium, aluminum, titanium alloys, aluminum alloys, steels (such as stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices and portions thereof according to this invention. When the same reference number appears in more than one drawing, that reference number is used consistently in this specification and the drawings to refer to the same or similar parts throughout.

At least some examples of ball striking devices according to this invention relate to golf club head structures, including heads for wood-type golf clubs, including drivers. Such devices may include a one-piece construction or a multiple-piece construction. An example structure of ball striking devices according to this invention will be described in detail below in conjunction with FIGS. 1 and 2, and will be referred to generally using reference numeral "100."

FIG. 1 illustrates an example of a ball striking device 100 in the form of a golf driver, in accordance with at least some examples of this invention. The ball striking device 100 includes a ball striking head 102 and a shaft 104 connected to the ball striking head 102 and extending therefrom. A ball 106 in use is also schematically shown in FIG. 1, in a position to be struck by the ball striking device 100.

The ball striking head 102 of the ball striking device 100 of FIG. 1 has a face 112 connected to a body 108, with a hosel 109 extending therefrom. Any desired hosel and/or head/shaft interconnection structure may be used without departing from this invention, including conventional hosel and/or head/shaft interconnection structures as are known and used in the art, including releasable head/shaft interconnections. For reference, the head 102 generally has a top 116, a bottom or sole 118, a heel 120 proximate the hosel 109, a toe 122 distal from the hosel 109, a front 124, and a back or rear 126. The shape and design of the head 102 may be partially dictated by the intended use of the device 100. In the club 100 shown in FIGS. 1 and 2, the head 102 has a relatively large volume, as the club 100 is designed for use as a driver or wood-type club, intended to hit the ball accurately over long distances. In other applications, such as for a different type of golf club, the head may be designed to have different dimensions and configurations. When configured as a driver, the club head may have a volume of at least 400 cc, and in some structures, at least 450 cc, or even at least 460 cc. Other appropriate sizes for other club heads may be readily determined by those skilled in the art.

In the embodiment illustrated in FIG. 1, the head 102 has a hollow structure defining an inner cavity (e.g., defined by the face 112 and the body 108). Thus, the head 102 has a plurality of inner surfaces defined therein. In one embodiment, the hollow center cavity may be filled with air. However, in other embodiments, the head 102 could be filled with another material, such as a foam. In still further embodiments, the solid materials of the head may occupy a greater proportion of the volume, and the head may have a smaller cavity or no inner cavity at all. It is understood that the inner cavity may not be completely enclosed in some embodiments.

The face 112 is located at the front 124 of the head 102, and has a ball striking surface 110 located thereon. The ball striking surface 110 is configured to face a ball 106 in use, and is adapted to strike the ball 106 when the device 100 is set in motion, such as by swinging. As shown, the ball striking surface 110 occupies most of the face 112. For reference purposes, the portion of the face 112 near the top face edge 113 and the heel 120 of the head 102 is referred to as the "high-heel area" 160; the portion of the face 112 near the top face edge 113 and toe 122 of the head 102 is referred to as the "high-toe area" 162; the portion of the face 112 near the bottom face edge 115 and heel 120 of the head 102 is referred to as the "low-heel area" 164; and the portion of the face 112 near the bottom face edge 115 and toe 122 of the head 102 is referred to as the "low-toe area" 166. Conceptually, these areas 160-166 may be recognized as quadrants of substantially equal size (and/or quadrants extending from a geometrical center of the face 112), though not necessarily with symmetrical dimensions. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the embodiment shown in FIG. 1, the ball striking surface 110 is inclined slightly (i.e., at a loft angle), to give the ball 106 slight lift and/or spin when struck. In other embodiments, the ball striking surface 110 may have a different incline or loft angle, to affect the trajectory of the ball 106. Additionally, the face 112 may have one or more internal or external inserts in some embodiments.

It is understood that the face 112, the body 108, and/or the hosel 109 can be formed as a single piece or as separate pieces that are joined together. In one embodiment, the face 112 is formed from a cup-face structure, such as shown in FIGS. 10-21, with a wall or walls 125 extending rearward from the edges 127 of the inner face surface 114. The body 108 can be formed as a separate piece or pieces joined to the walls 125 of the cup-face by an integral joining technique, such as welding, cementing, or adhesively joining. Other known techniques for joining these parts can be used as well, including many mechanical joining techniques, including releasable mechanical engagement techniques. If desired, the hosel 109 may be integrally formed as part of the cup-face.

The ball striking device 100 may include a shaft 104 connected to or otherwise engaged with the ball striking head 102, as shown schematically in FIG. 1. The shaft 104 is adapted to be gripped by a user to swing the ball striking device 100 to strike the ball 106. The shaft 104 can be formed as a separate piece connected to the head 102, such as by connecting to the hosel 109, as shown in FIG. 1. In other embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some exemplary embodiments, the shaft 104, or at least portions thereof, may be constructed of a metal, such as stainless steel, or a composite, such as a carbon/graphite fiber-polymer composite. However, it is contemplated that the shaft 104 may be constructed of different materials without departing from the scope of the invention, including conventional materials that are known and used in the art.

In general, the head 102 of the ball striking device 100 has one or more stiffening members extending rearward from the inner surface 114 of the face 112 for providing increased stiffness to certain areas or portions of the face 112. FIGS. 2-23B illustrate various embodiments of ball striking faces 200, 300, 400, 500, 600, 700, 800, 900, 1000, 1100, having different numbers and configurations of stiffening members. Each of these configurations can be used as the face 112 of the ball striking device 100 as shown in FIG. 1, or various other configurations for ball striking devices within the scope of the present invention. Thus, common features of the face 112 and the faces 200, et seq. described below are referred to with common reference numbers used to describe the face 112 of FIG. 1.

FIGS. 2-6 depict embodiments of a ball striking face 200 having a stiffening member 202, 204, 206 spaced from the inner surface 114 of the face 200 and extending across at least a portion of the face 200. In each of these embodiments, the stiffening member 202, 204, 206 has a plurality of legs 210, each attached to the inner surface 114 of the face 200 at a contact point 212, and an arm or arms 214 extending between the legs 210. The legs 210 extend away from the face substantially perpendicular to the inner surface 114 of the face 200 (although other angled extensions are possible), such that the arm 214 is spaced from the inner surface 114. Connection of the legs 210 to the inner face surface 114 can be done by a variety of methods. In one embodiment, the legs 210 can be connected to the inner surface 114 by welding or another integral joining technique, and in other embodiments, the stiffening member 202, 204, 206 may be formed with the face 200 as a single, integral piece, or may be joined by fasteners, adhesive, or non-integral joining techniques. The stiffening member 202, 204, 206 provides locally increased stiffness to areas 216 of the face 200 surrounding the contact points 212, relative to other areas of the face 200 located away from the contact points 212.

Figure 2:
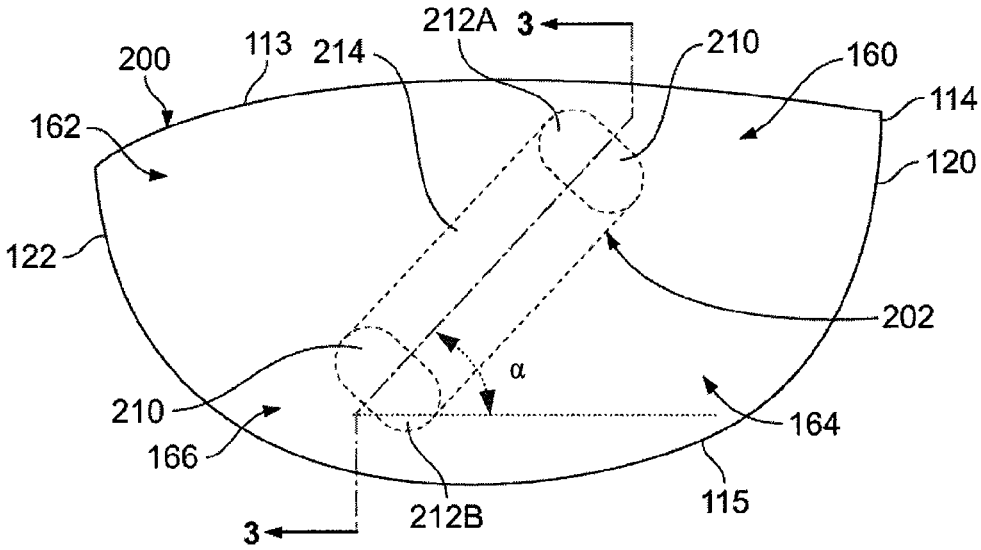
FIG. 2 is a front view of a first embodiment of a face of a ball-striking device, with a rearwardly extending stiffening member depicted in broken lines.
Figure 3:
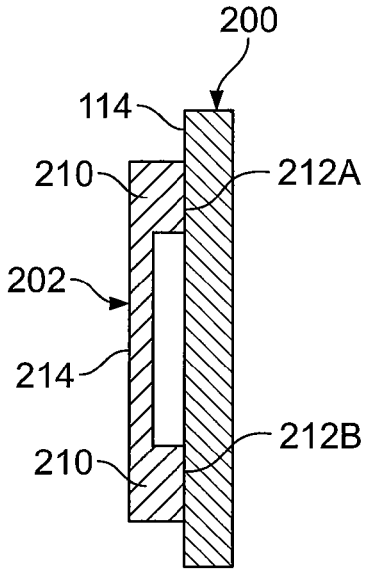
FIG. 3 is a cross-sectional view of the face and stiffening member of FIG. 2, taken along line 3-3 of FIG. 2.

In the embodiment shown in FIGS. 2 and 3, the stiffening member 202 extends in an angled manner across a portion of the face 200 in a direction from the high-heel area 160 toward the low-toe area 166 of the face 200. This example stiffening member 202 has two contact points 212 with the face 110, with one contact point 212A located in the high-heel area 160 and the other contact point 212B located in the low-toe area 166 of the face 200. The arm 214 takes the form of a bar that extends between the legs 210 provided at the contact points 212. In this configuration, the stiffening member 202 provides locally increased stiffness to the high-heel and low-toe areas 160, 166 of the face 200 (and areas of relatively locally increased flexibility in the low-heel area 162 and high toe area 164, e.g., areas of the face 110 where many golfers tend to contact the ball).

The contact points 212A and 212B may be located any desired distance apart. As some more specific examples, the contact points 212A and 212B may be located between 0.5 and 4.5 inches apart, and in some examples, between 0.75 and 4 inches apart, between 1 and 3.5 inches apart, or even between 1.25 and 3 inches apart. Also, the angle $\alpha$ of the arm 214 with respect to a horizontal direction (when the club is in a ball address position) may be between 10° and 80°, and in some example structures, between 20° and 70° or even between 30° and 60°.

Figure 4:
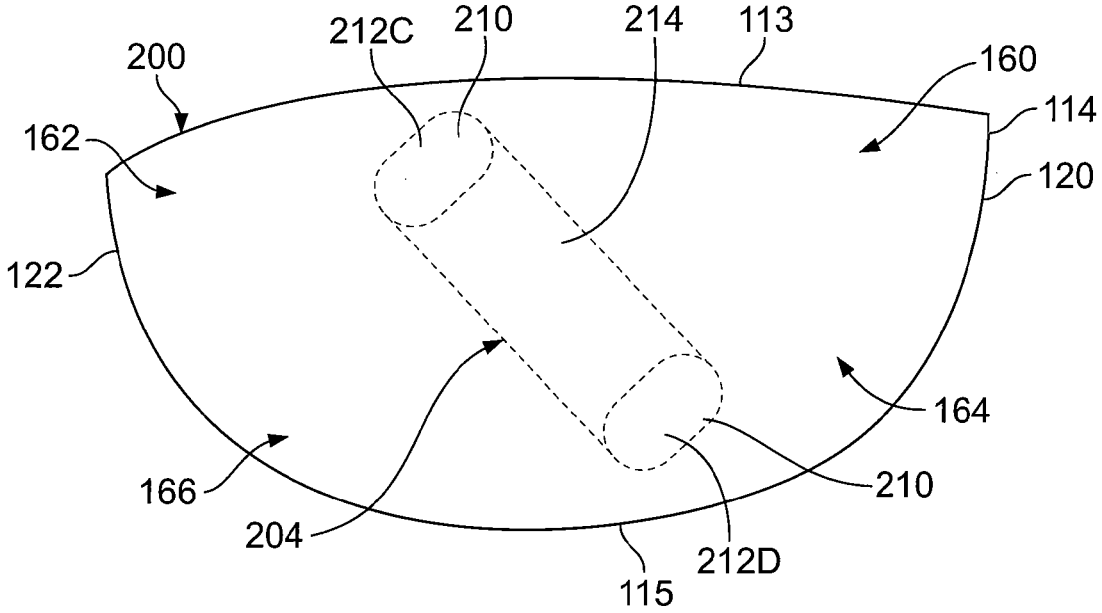
FIG. 4 is a front view of a second embodiment of a face of a ball-striking device, with a stiffening member depicted in broken lines.

In the embodiment shown in FIG. 4, the stiffening member 204 is similar to the stiffening member 202 of FIGS. 2 and 3, but it is placed in the opposite orientation. The stiffening member 204 in this example structure extends in an angled manner across a portion of the face 200 in a direction from the low-heel area toward the high-toe area of the face 200. This example stiffening member 204 has two contact points 212, with one contact point 212C located in the high-toe area 162 and the other contact point 212D located in the low-heel area 164 of the face 200. In this configuration, the stiffening member 204 provides locally increased stiffness to the high-toe and low-heel areas 162, 164 of the face 200 (and it provides areas of relatively locally increased flexibility in the high heel area 160 and the low toe area 166 of the face 110). The stiffening member 204 may have the size, relative positioning, and/or angle properties of the stiffening member 202 described above in conjunction with FIGS. 2 and 3.

Figure 5:
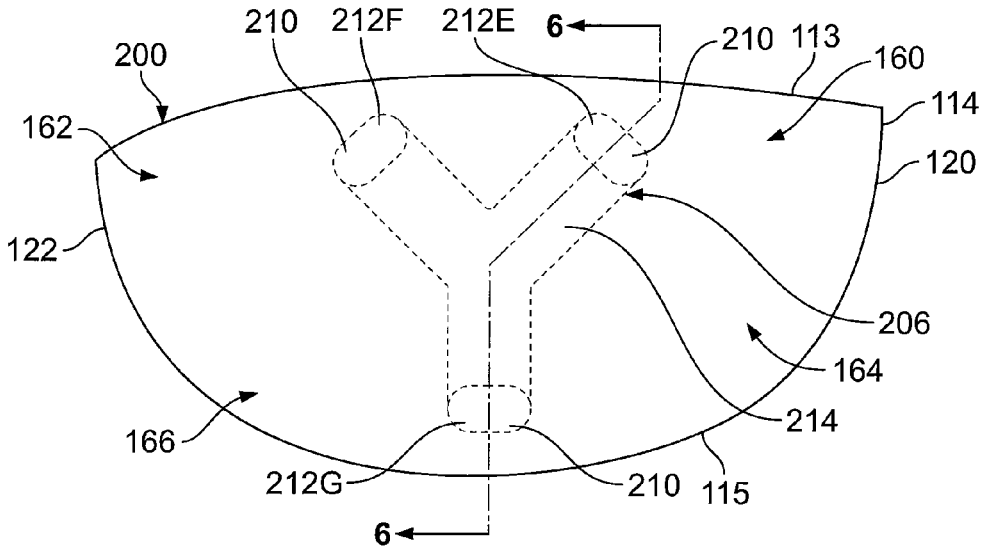
FIG. 5 is a front view of a third embodiment of a face of a ball-striking device, with a stiffening member depicted in broken lines.
Figure 6:
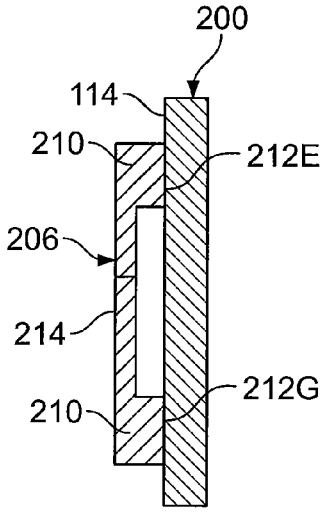
FIG. 6 is a cross-sectional view of the face and stiffening member of FIG. 5, taken along line 6-6 of FIG. 5.

In the embodiment shown in FIGS. 5 and 6, the stiffening member 206 has a Y-shaped configuration and extends across a portion of the face 200. This stiffening member 206 has three contact points 212, with one contact point 212E located in the high-heel area 160, a second contact point 212F located in the high-toe area 166, and a third contact point 212G located proximate the low-center of the face 200. The arm 214 takes the form of a Y-shaped bar that extends between the contact points 212. In this configuration, the stiffening member 206 provides locally increased stiffness to the high-heel and high-toe areas 160, 162 of the face 200, as well as the center of the face 200 (and relatively locally increased flexibility to other areas of the face). It is understood that the Y-shaped stiffening member 206 may be oriented differently to provide locally increased stiffening to other portions of the face 200, such as in a configuration that is inverted or rotated relative to the stiffening member 206 as shown in FIG. 5 and/or shifted toward the toe or heel. The various arms of the Y-structure may have the same or different lengths without departing from this invention, and they may extend from a central area by consistent or different angles.

In the embodiments shown in FIGS. 2, 4, and 5, the legs 210 of the stiffening members 202, 204, 206 are obround or oval in cross-section, and the contact points 212 between the stiffening members 202, 204, 206 and the face 200 are also obround or oval. However, it is understood that the stiffening members 202, 204, 206 may have different cross-sections, and they may vary in cross-section at different portions along their length. It is also understood that the arm portions 210 of the stiffening member 202, 204, 206 may extend beyond the contact points 212, such as in a cantilevered arrangement or into the rear of the ball striking face 200. In other embodiments, the stiffening member may have a differently-shaped configuration (e.g., X-shape, square shape, diamond shape, etc.). In such embodiments, the stiffening member may have a different number of contact points as well. In further embodiments, the face 200 may have multiple stiffening members, which may be similar to the stiffening members 202, 204, 206 or may have another configuration, such as the stiffening members described below.

Figure 7:
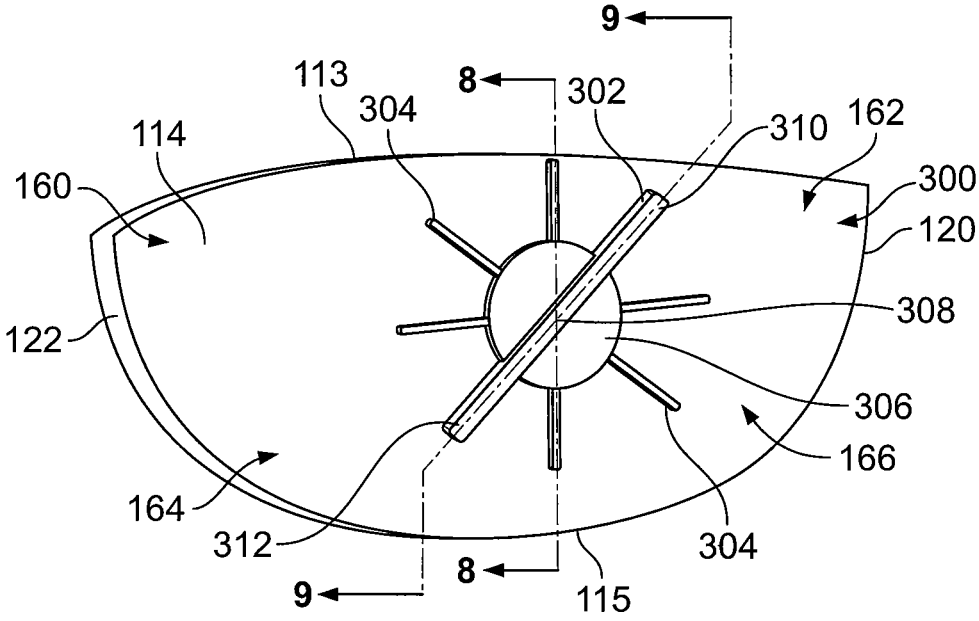
FIG. 7 is a rear view of a fourth embodiment of a face of a ball-striking device.
Figure 8:
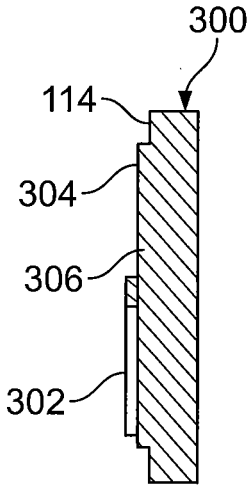
FIG. 8 is a cross-sectional view of the face of FIG. 7, taken along line 8-8 of FIG. 7.
Figure 9:
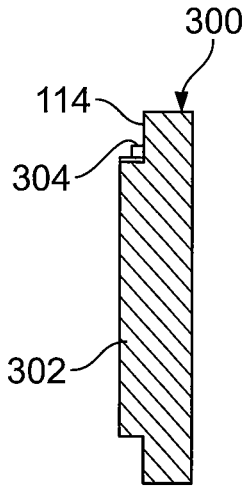
FIG. 9 is a cross-sectional view of the face of FIG. 7, taken along line 9-9 of FIG. 7.

FIGS. 7-9 illustrate another embodiment of a face 300 for a ball striking device, having a plurality of interconnected stiffening members 302, 304, 306 arranged in a radiating formation on the inner surface 114 of the face 300. In the embodiment illustrated, the stiffening members 302, 304, 306 are integrally connected to the face 300, such as by being formed integrally with the face 300 or by being connected by an integral joining technique. It is understood that in other embodiments, the stiffening members 302, 304, 306 may not be integrally connected to the face 300. In the configuration illustrated in FIGS. 7-9, the primary stiffening member 302 extends in a high-heel to low-toe direction, from a first point 310 to a second point 312 on the inner surface 114 of the face 300. In this example structure 300, the first point 310 is located in the high-heel area 160 of the face and the second point 312 is located in the low-toe area 166, and the primary stiffening member 302 extends generally across both the horizontal and vertical centerlines of the face 300, but it does not extend to the edges of the face 300. However in other embodiments, this may not be the case, and the primary stiffening member 302 may be arranged differently. For example, the primary stiffening member 302 may extend in the high-toe to low-heel direction, and may or may be positioned mostly or entirely on one half or on one quadrant of the face 300. The center of the primary stiffening member 302 may be shifted in the horizontal and/or vertical directions A plurality of secondary stiffening members 304 are arranged proximate the primary stiffening member 302 in this example structure 300 such that the primary and secondary stiffening members 302, 304 radiate from a central point 308. The central point 308 is located proximate the center of the primary stiffening member 302 in the embodiment illustrated, and it may be located at the geometrical center of the face 300, if desired (although off-center positions are possible). A disc-shaped central stiffening member 306 is also positioned centered at the point 308. Generally, the primary stiffening member 302 is able to provide a greater degree of locally increased stiffness than the other stiffening members 304, 306. As seen in FIGS. 7-9, the secondary members 304 and the central member 306 have similar thicknesses, and the primary stiffening member 302 has a greater thickness relative to the other stiffening members 304, 306. Additionally, in this illustrated example structure 300, the primary stiffening member 302 has a greater width relative to the secondary stiffening members 304. In this embodiment, the increased stiffness of the primary member 302 and the areas around it results from the increased thickness and width thereof. In another embodiment, the primary stiffening member 302 may produce increased stiffness through another mechanism, such as by having greater yield strength or reduced flexibility. Such properties may be achieved, for example, through strengthening techniques or by using a different material for the primary stiffening member 302.

If desired, any of the primary stiffening member 302 and/or the secondary stiffening members 304 and/or 306 may be offset from the center point 308. Additionally or alternatively, if desired, the overall stiffening member need not have the generally symmetrical structure shown in FIG. 7. For example, the central stiffening member 306 need not be round, and/or the various stiffening member legs need not be aligned and/or of the same lengths.

While the stiffening members may have any desired dimensions, if desired, the secondary stiffening members 304 and/or 306 may be from about 0.1 to 2 mm thick, and optionally, from about 0.25 to 1.75 mm thick or from 0.5 to 1.5 mm thick. The primary stiffening member 302 may be from 20 to 200% thicker, e.g., from 0.12 to 6 mm thick, and in some examples, from 0.25 to 5 mm thick, or even from 0.5 to 4 mm thick. This "thickness" is measured as the distance the stiffening members extend away from the inner surface 114 of the face 300. The entire area of the stiffening members 302, 304, and/or 306 combined may occupy from 5-50% of the interior surface area of the face, and in some examples, from 10-40% or even from 15-30% of this interior surface area.

FIGS. 10-17 illustrate additional embodiments of ball striking faces 400, 500, 600, 700 containing a plurality of stiffening members in accordance with examples of this invention. In these embodiments, the faces 400, 500, 600, 700 are illustrated as part of a cup-face structure adapted to be connected to one or more body members (e.g., body 108) as described above to form a ball striking device. The cup-face structure includes a wall or walls 125 (also called a "return portion") extending rearward from the perimeter edges 127 of the face 400, 500, 600, 700, generally transverse to the face 400, 500, 600, 700. It is understood that the interior surface and/or variable face thickness features of the faces 400, et seq. can be used in other types of face configurations without departing from this invention.

Figure 20:
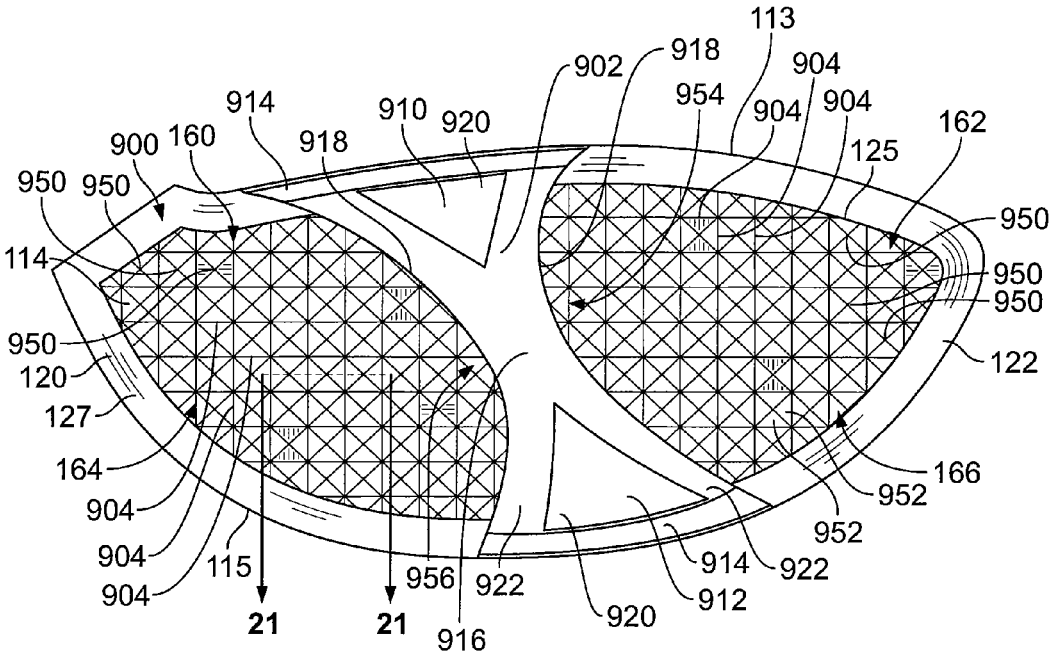
FIG. 20 is a rear view of a tenth embodiment of a face of a ball-striking device.
Figure 21:
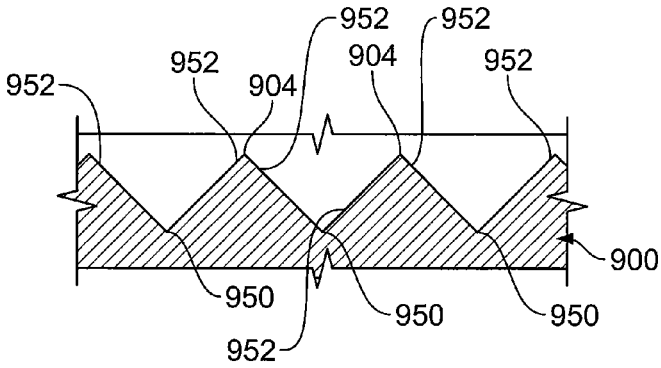
FIG. 21 is a partial cross-sectional view of the face of FIG. 20, taken along line 21-21 of FIG. 20.

Each of the faces 400, et seq. depicted in FIGS. 10-17 contains a primary stiffening member 402, 502, 602, 702 and a plurality of secondary stiffening members 404, 504, 604, 704 extending rearward from the inner surface 114 of the face 400, et seq. and providing locally increased stiffness to surrounding areas of the face 400, et seq. Generally, the primary stiffening member 402, 502, 602, 702 of each embodiment provides a greater degree of locally increased stiffness to the face 400, et seq. than each of the secondary stiffening members 404, 504, 604, 704. The primary stiffening members 402, 502, 602, 702 of these four example embodiments are substantially the same, and will be described below with reference to the primary stiffening member 402 of the face 400 illustrated in FIGS. 10 and 14. It is understood that the primary stiffening members 502, 602, 702 of the faces 500, 600, 700 of FIGS. 11-13 and 15-17 contain similar features, which are similarly referred to using the "500," "600," and "700" series of reference numbers, respectively. Likewise, the embodiment of the face 900 illustrated in FIGS. 20 and 21 also contains a similar primary stiffening member 902, and the features of the primary stiffening member 902 of FIGS. 20 and 21 are similarly referred to using the "900" series of reference numbers. The secondary stiffening members 404, 504, 604, 704 of these faces 400, et seq. are differently configured, and are described individually below with respect to each embodiment. In the embodiments illustrated, the stiffening members 402, 404, 502, 504, 602, 604, 702, 704 are integrally connected to the face 400, et seq., such as by being formed integrally with the face 400, et seq. or being connected by an integral joining technique. It is understood that in other embodiments, however, the stiffening members 402, 404, 502, 504, 602, 604, 702, 704 may not be integrally connected to the face 400, et seq. Moreover, in a given face structure, the various stiffening members need not be structured, dimensioned, or connected to the face in a common manner. If desired, the primary stiffening members may be 25-300% thicker than the secondary stiffening members, and in some examples, from 50-200% thicker, or even 75-150% thicker (as measured from the rear surface 114 of the face), e.g., from 0.5 to 8 mm thick.

Figure 10:
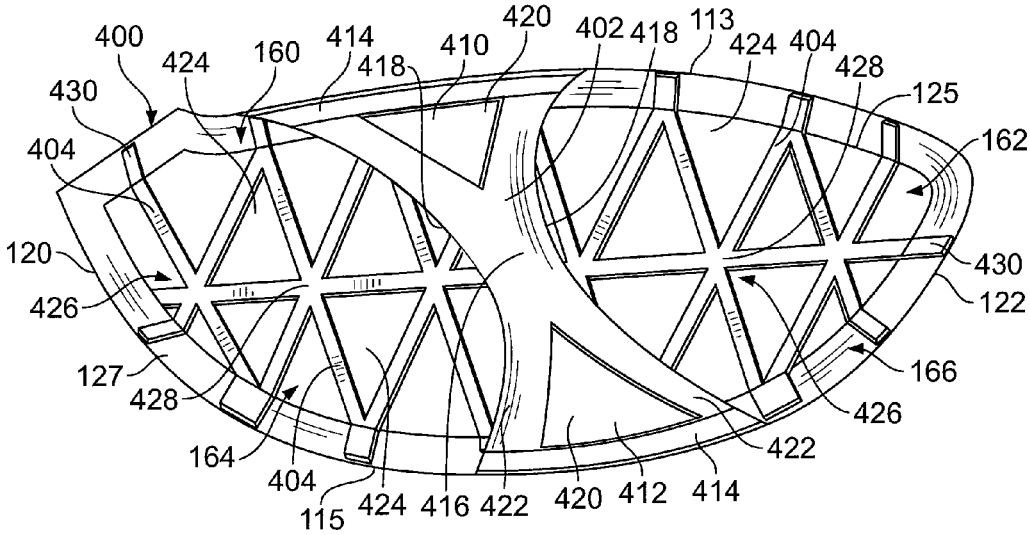
FIG. 10 is a rear view of a fifth embodiment of a face of a ball-striking device.
Figure 14:
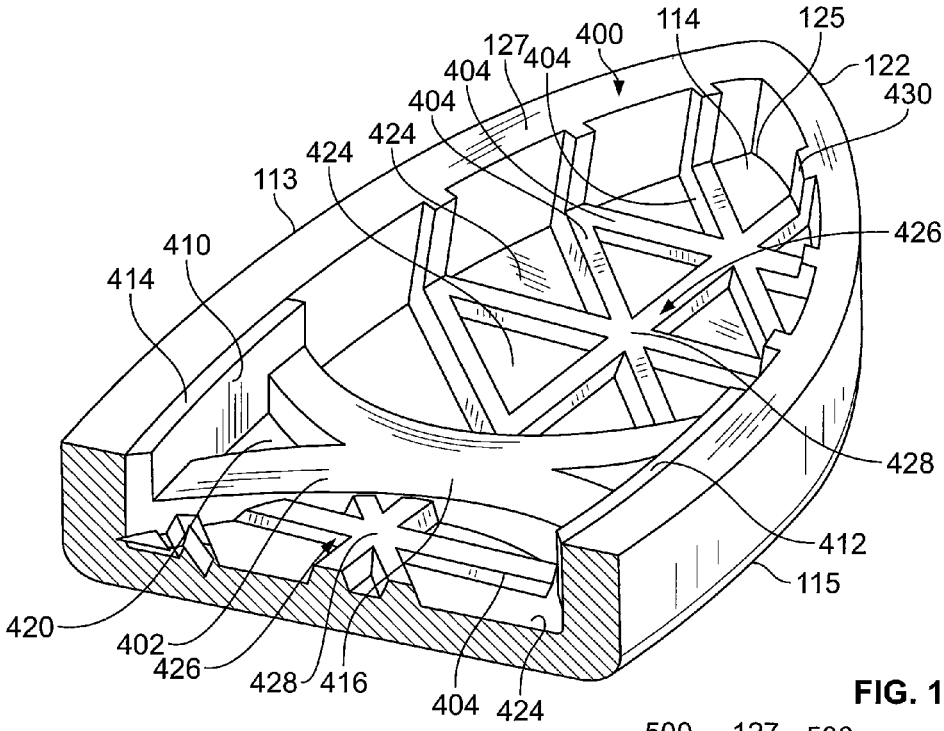
FIG. 14 is a perspective cross-sectional view of the face of FIG. 10.

Generally, the primary stiffening member 402 illustrated in FIGS. 10 and 14 extends across the inner surface 114 of the face 400 in an angled manner, in a high-heel to low-toe direction, from a first point 410 to a second point 412 on the inner surface 114 of the face 400, such that the second point 412 is located toward the bottom 115 and the toe 122 of the face 400 relative to the first point 410. In this embodiment, the first point 410 is located in the high-heel area 160 of the face and the second point 412 is located in the low-toe area 166, and the primary stiffening member 402 extends across both the horizontal and vertical centerlines of the face 400, to the edges 127 of the face 400. However in other embodiments, this may not be the case, and the primary stiffening member 402 may be arranged differently (e.g., shifted toward the heel or toe, not as longitudinally long, angled at any desired direction from horizontal, etc.). As some additional examples, the primary stiffening member 402 may extend in the high-toe to low-heel direction, and/or it may be positioned mostly or entirely on one half or on one quadrant of the face 400. Additionally, in this embodiment, the primary stiffening member 402 has transverse components 414 at opposite ends, extending transverse to the inner surface 114 and up the walls 125 of the cup face structure (although these transverse components 414 may be omitted, if desired).

This example primary stiffening member 402 has a tapered or curved configuration, having a greater width at its ends (e.g., near the first point 410 and the second point 412) than at its center 416. In this embodiment, the primary stiffening member 402 is elongated along an imaginary line of elongation (e.g., a central longitudinal axis) passing through the first and second points 410, 412, and the width of the primary stiffening member 402 is tapered or curved when measured generally perpendicular to the direction of the longitudinal axis of the primary stiffening member 402. The primary stiffening member 402 illustrated in FIGS. 10 and 14 is tapered or curved in a concavely-curved manner, and it is defined on opposed sides by concave curvilinear edges 418 tapering inward toward the center 416. In this embodiment, the primary stiffening member 402 also includes gaps or recesses 420 at opposite ends, which may either be areas of reduced thickness compared to the adjacent areas of the member 402 or apertures extending completely through the member 402. The shape of the gaps 420 illustrated in FIGS. 10 and 14 gives the primary stiffening member 402 an X-shape, defined by two curvilinear ribs 422 diverging proximate the first point 410 and the second point 412, separated by the gaps 420, and then converging at the center 416 of the primary stiffening member 402. Due to the increased width of the primary stiffening member 402 proximate the ends, the member 402 in this configuration can provide greater locally increased stiffness and/or a larger area of locally increased stiffness proximate the ends of the primary stiffening member 402 than at the center 416 thereof. As shown in FIGS. 10 and 14, a bulk or majority of the area of the primary stiffening member 402 is located in the high-heel area 160 and low-toe area 166 of the face 400 (e.g., in the high heel and low toe quadrants of the face 400), and thus, the primary stiffening member 402 provides the greatest proportion of its strengthening and increased stiffness in the high-heel and low-toe areas 160, 166 of the face 400. Accordingly, this face 400 tends to be somewhat more flexible in the high-toe and low-heel quadrants, areas of the club head where many golfers tend to make contact with the ball. If desired, the primary stiffening member 402 may occupy about 5-30% of the inner surface area of the face 400, and in some examples, from 5-25% of this area.

The secondary stiffening members 404 of the embodiment of FIGS. 10 and 14 take the form of substantially linear ribs that are arranged in a crossing pattern on the inner surface 114 of the face 400. The pattern formed by the secondary stiffening members 404 in this illustrated example structure defines a plurality of triangular-shaped recesses or troughs 424 between the secondary stiffening members 404. Additionally, the secondary stiffening members 404 are arranged to form a plurality of interconnected radiating formations 426, wherein the secondary stiffening members 404 of each radiating formation 426 radiate from a central point 428. The triangular recesses 424 also radiate from the central points 428. Each of the central points 428 in this example structure 400 is positioned proximate the horizontal centerline of the face 400, although some may be positioned slightly above the centerline (e.g., in the high-toe area 162 of the face), and some may be positioned slightly below the centerline (e.g., in the low-heel area 164 of the face), if desired. The secondary stiffening members 404 of this embodiment further contain transverse components 430 at the edges 127 of the face 400, extending transverse to the inner surface 114 and up the walls 125 of the cup face structure, although these transverse components 430 need not be provided. The secondary stiffening members 404 provide locally increased stiffness to the surrounding areas of the face, centered at the central points 428. In this embodiment, the locally increased stiffness provided by the primary stiffening member 402 is greater than the locally increased stiffness provided by the secondary stiffening members 404. The secondary stiffening members 404, when present, may occupy from 1-25% of the inner surface area of the face, and in some examples, from 2 to 20%, or even from 4 to 15%.

Figure 11:
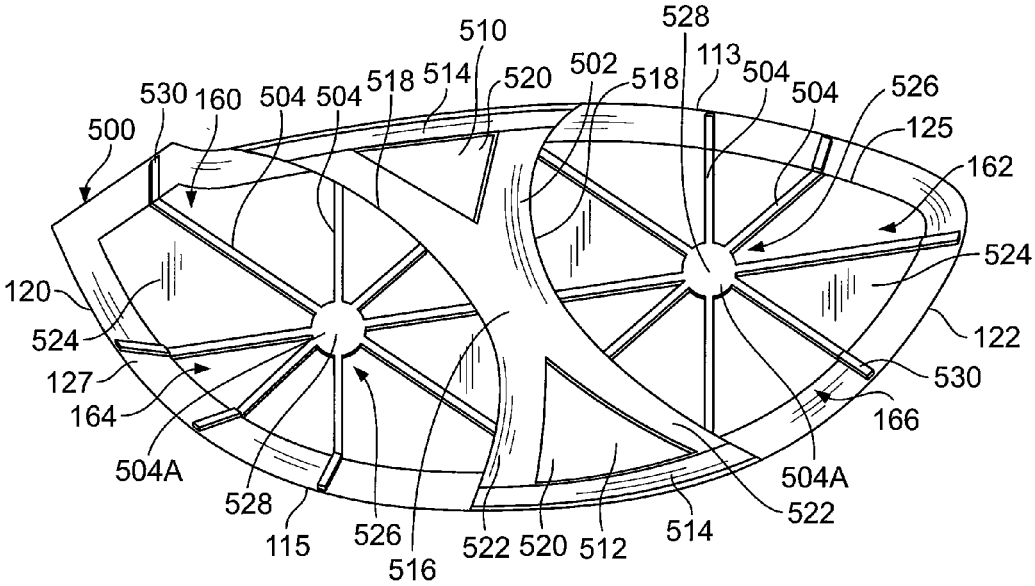
FIG. 11 is a rear view of a sixth embodiment of a face of a ball-striking device.
Figure 15:
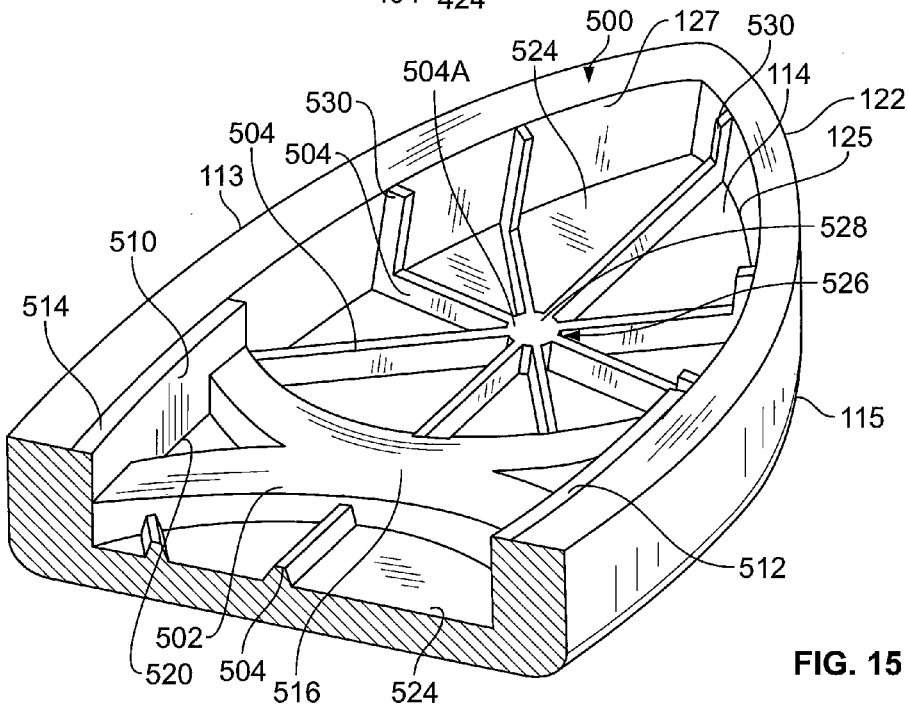
FIG. 15 is a perspective cross-sectional view of the face of FIG. 11.

FIGS. 11 and 15 depict another embodiment of a ball striking face 500, in which the primary stiffening member 502 is similar to the primary stiffening member 402 of FIGS. 10 and 14, as described above. In FIGS. 11 and 15, the secondary stiffening members 504 take the form of substantially linear ribs arranged to form two radiating formations 526, wherein the secondary stiffening members 504 of each radiating formation 526 radiate from a central point 528. One of the central points 528 in this example structure 500 is positioned in the high-toe area 162 of the face 500, and the other central point 528 is positioned in the low-heel area 164 of the face 500 (although other arrangements are possible). Additionally, a circular disc-shaped stiffening member 504A is positioned centered at each central point 528, with the other secondary stiffening members 504 extending from the edges of the circular stiffening member 504A. This configuration of the secondary stiffening members 504 produces a plurality of substantially triangular or wedge-shaped recesses or troughs 524 between the secondary stiffening members 504. These wedge-shaped recesses 524 also radiate from the central point 528. The secondary stiffening members 504 of this embodiment further contain transverse components 530 at the edges 127 of the face 500, extending transverse to the inner surface 114 and up the walls 125 of the cup face structure (although the transverse components 530 may be omitted, if desired). The secondary stiffening members 504 provide locally increased stiffness to the surrounding areas of the face, centered at the points 528. In this embodiment, the locally increased stiffness provided by the primary stiffening member 502 is greater than the locally increased stiffness provided by the secondary stiffening members 504.

Any number of radiating formations 526 may be provided without departing from this invention, including, for example, from 1-5. The radiating formations 526 may cover, for example, from 1-25% of the inner surface area of the face, and in some examples, from 2-20%, or even from 4-15% of the interior face surface area.

Figure 12:
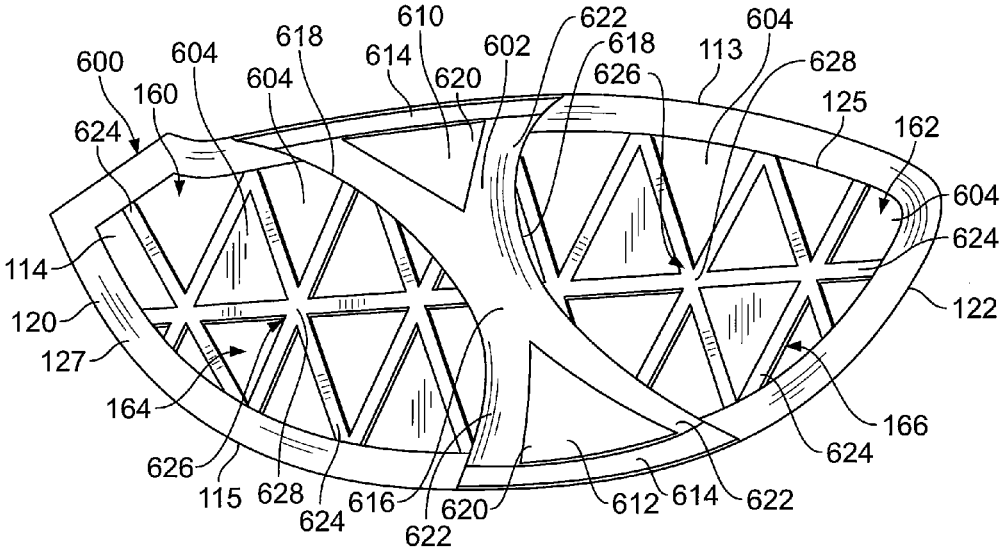
FIG. 12 is a rear view of a seventh embodiment of a face of a ball-striking device.
Figure 16:
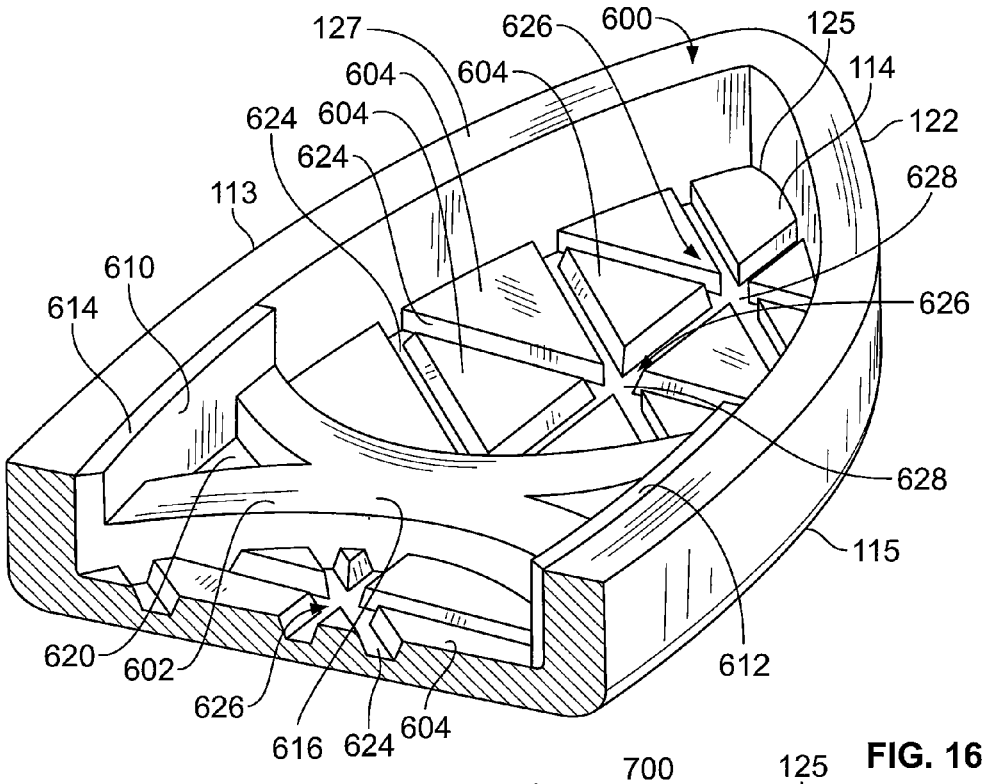
FIG. 16 is a perspective cross-sectional view of the face of FIG. 12.

FIGS. 12 and 16 depict another embodiment of a ball striking face 600, in which the primary stiffening member 602 is similar to the primary stiffening member 402 of FIGS. 10 and 14, as described above. The secondary stiffening members 604 of FIGS. 12 and 16 are arranged in an approximate inverse relation to the secondary stiffening members 404 of FIGS. 10 and 14. As shown in FIGS. 12 and 16, the secondary stiffening members 604 are formed as a plurality of triangular or wedge-shaped stiffening members 604 that are arranged to form a crossing pattern of substantially linear recesses or troughs 624 therebetween. Additionally, the secondary stiffening members 604 are arranged to form a plurality of radiating formations 626, wherein the secondary stiffening members 604 of each radiating formation radiate from a central point 628. The linear recesses 624 also radiate from the central points 628. Each of the central points 628 is positioned proximate the horizontal centerline of the face 600, although some may be positioned slightly above the centerline (e.g., in the high-toe area 162 of the face), and some may be positioned slightly below the centerline (e.g., in the low-heel area 164 of the face). The secondary stiffening members 604 provide locally increased stiffness to the surrounding areas of the face, centered at the central points 628. In this embodiment, the locally increased stiffness provided by the primary stiffening member 602 is greater than the locally increased stiffness provided by the secondary stiffening members 604. The secondary stiffening members 604, when present, may occupy from 25% to 80% of the inner surface area of the face, and in some examples, from 50-75%

Figure 13:
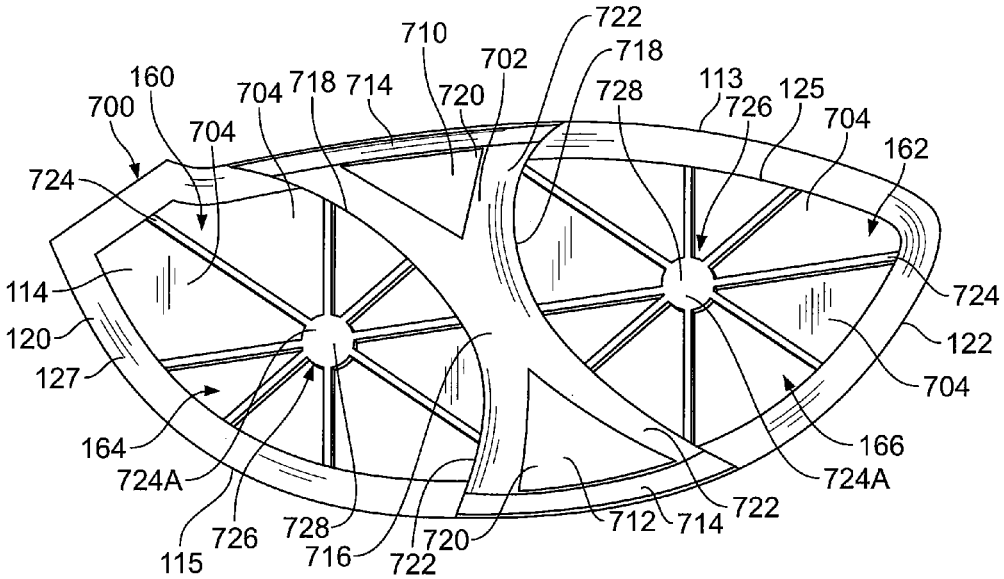
FIG. 13 is a rear view of an eighth embodiment of a face of a ball-striking device.
Figure 17:
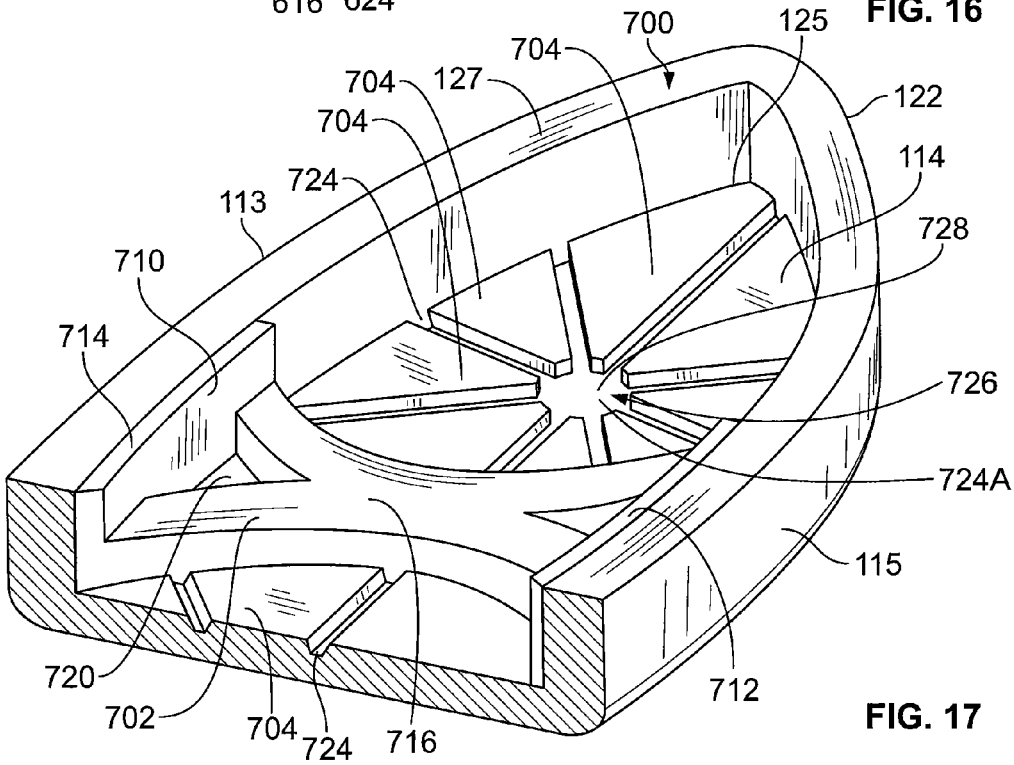
FIG. 17 is a perspective cross-sectional view of the face of FIG. 13.

FIGS. 13 and 17 depict another embodiment of a ball striking face 700, in which the primary stiffening member 702 is similar to the primary stiffening member 402 of FIGS. 10 and 14, as described above. The secondary stiffening members 704 of FIGS. 13 and 17 are arranged in an approximate inverse relation to the secondary stiffening members 504 of FIGS. 11 and 15. As shown in FIGS. 13 and 17, the secondary stiffening members 704 are formed as a plurality of substantially triangular or wedge-shaped stiffening members 704 that are arranged to form two radiating formations 726, wherein the secondary stiffening members 704 of each radiating formation 726 radiate from a central point 728. The secondary stiffening members 704 also form substantially linear recesses or troughs 724 therebetween, and the substantially linear recesses 724 also radiate from the central points 728. One of the central points 728 is positioned in the high-toe area 162 of the face 700, and the other central point 728 is positioned in the low-heel area 164 of the face 700 (although other arrangements are possible). Additionally, a circular disc-shaped recess 724A is positioned centered at each central point 728, with the other recesses 724 extending to the edges of the circular recess 724A. The secondary stiffening members 704 provide locally increased stiffness to the surrounding areas of the face, centered at the central points 728. In this embodiment, the locally increased stiffness provided by the primary stiffening member 702 is greater than the locally increased stiffness provided by the secondary stiffening members 704. As with FIGS. 11 and 15, any number of radiating formations 726 may be provided, for example, from 1-5. The recesses that define the radiating formations 726 may cover, for example, from 1-25% of the inner surface area of the face, and in some examples, from 2-20%, or even from 4-15% of the interior surface area.

Figure 18:
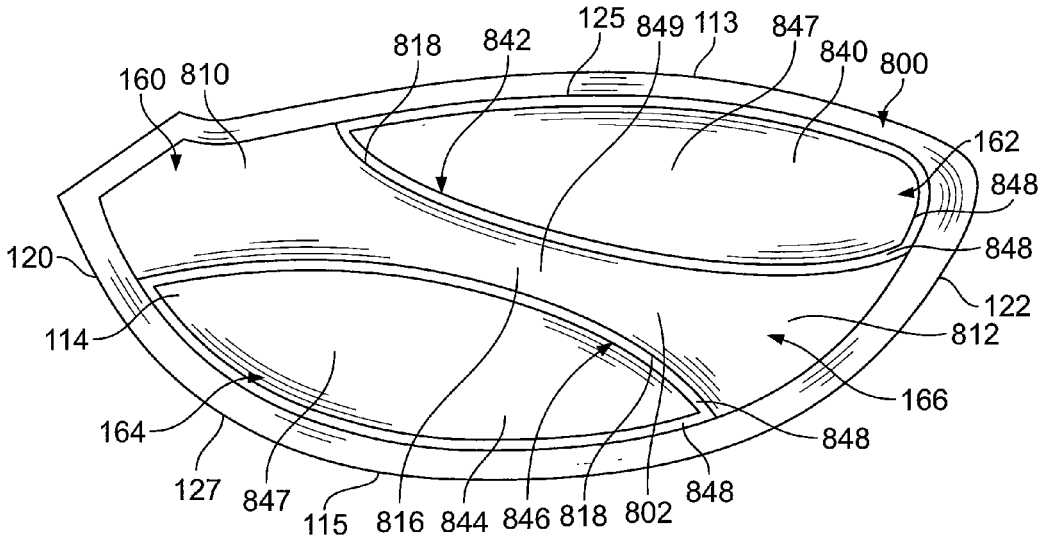
FIG. 18 is a rear view of a ninth embodiment of a face of a ball-striking device.
Figure 19:
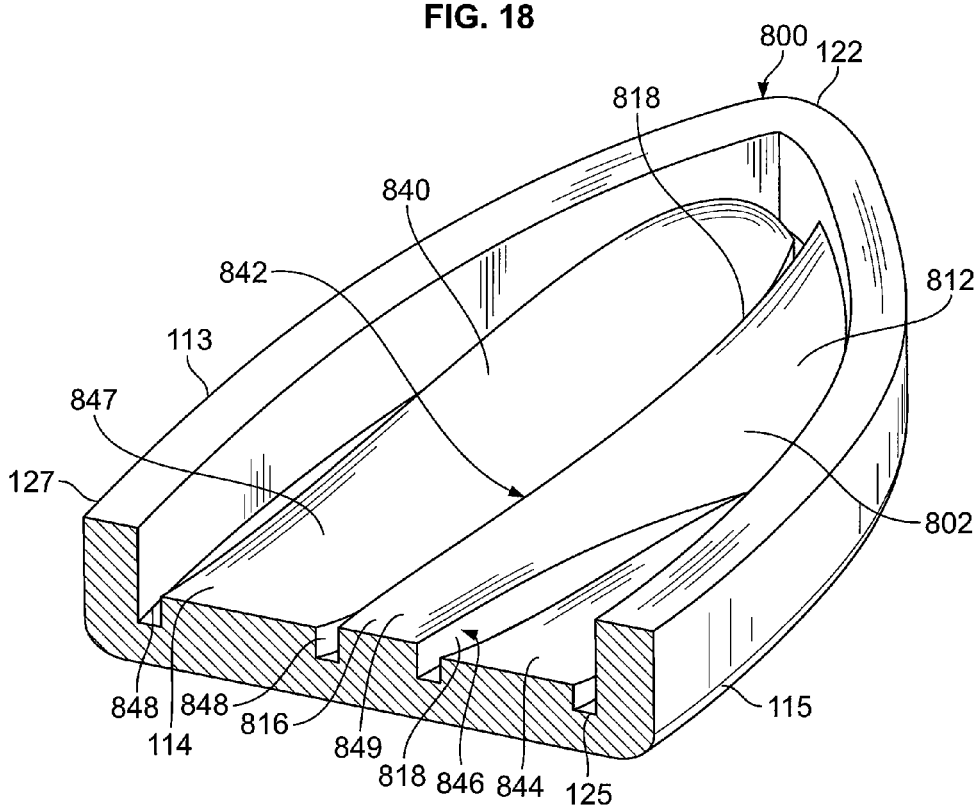
FIG. 19 is a perspective cross-sectional view of the face of FIG. 18.

FIGS. 18 and 19 illustrate another embodiment of a ball striking face 800 having a stiffening member 802 extending rearward from the inner surface 114 of the face 800 and having a central longitudinal axis extending across the face 800 between a first point 810 and a second point 812. Generally, the stiffening member 802 extends across the inner surface 114 of the face 800 in an angled manner, e.g., in a high-heel to low-toe direction, such that the second point 812 is located toward the bottom 115 and the toe 122 of the face 800 relative to the first point 810. In the embodiment illustrated in FIGS. 18 and 19, the first point 810 is located in the high-heel area 160 of the face 800 near the shaft connection area and the second point 812 is located in the low-toe area 166, and the stiffening member 802 extends generally across both the horizontal and vertical centerlines of the face 800, to the edges 127 of the face 800. However, in other embodiments, this may not be the case, and the stiffening member 802 may be arranged differently. For example, the stiffening member 802 may extend in the high-toe to low-heel direction, and/or it may be positioned mostly or entirely on one half or on one quadrant of the face 800. Additionally, in this embodiment, the stiffening member 802 has a convex thickness profile, having a thickness that is lowest proximate the first point 810 and/or the second point 812 and greatest proximate the midpoint or center 816 of the stiffening member 802.

The stiffening member 802 of this example structure 800 has a tapered or curved configuration, having a greater width at the ends (e.g., near the first point 810 and the second point 812) than at the center 816 of the stiffening member 802. In this embodiment, the stiffening member 802 is elongated along a central longitudinal axis passing through the first and second points 810, 812, and the width of the stiffening member 802 is tapered or curved when measured generally perpendicular to the direction of elongation of the stiffening member 802 (e.g., perpendicular to its longitudinal axis). The stiffening member 802 illustrated in FIGS. 18 and 19 is tapered in a concavely-curved manner, and it is defined on opposed sides by concave curvilinear edges 818 tapering inward toward the center 816. Due to the increased width of the stiffening member 802 proximate the ends, the member 802 in this configuration can provide greater locally increased stiffness and/or a larger area of locally increased stiffness proximate the ends of the stiffening member 802 than at the center 816 thereof. As shown in FIGS. 18-19, a bulk or majority of the area of the primary stiffening member 802 is located in the high-heel quadrant and the low-toe quadrant of the face 800, and thus, the primary stiffening member 802 provides the greatest proportion of its strengthening and increased stiffness in the high-heel and low-toe areas 160, 166 of the face 800. The primary stiffening member 802 of this example structure 800 may cover from 5-50% of the surface area of the inner surface of the face, and in some examples, from 10-45%, or even from 15-40% of the inner surface area. The primary stiffening member 802 may extend from 0.25 to 8 mm the inner surface of the face, and in some examples, from 0.5 to 6 mm, or even from 0.75 to 5 mm.

In the embodiment illustrated in FIGS. 18-19, the inner surface 114 of the face 800 has two concave portions 840, 844 located on either side of the stiffening member 802. A first concave portion 840 is located on one side 842 of the stiffening member 802 and a second concave portion 844 is located on the opposite side 846 of the stiffening member 802. Each of the concave portions 840, 844 has a concave thickness profile, having a face thickness that is greatest at the ends (i.e., as the concave portions 840, 844 approach the first point 810 and the second point 812, respectively) and having a face thickness that is lowest proximate the center of the concave portions 840, 844 (e.g., proximate the center 816 of the stiffening member 802). Accordingly, the concave portions 840, 844 and the stiffening member 802 have opposite thickness profiles, and the concave portions 840, 844 have their lowest face thickness (approximately at point 847, e.g., optionally at the geometric center of the individual concave portions 840, 844) adjacent the point of the greatest face thickness of the stiffening member 802 (approximately at point 849). In other embodiments, these thickness profiles may be different, and may be reversed, with the stiffening member having a concave profile and the adjacent portions of the face having a convex profile. Additionally, each of the concave portions 840, 844 in this illustrated example structure is surrounded and defined by boundary recesses 848, which separate the concave portions 840, 844 from the edges 125 of the face 800 and also from the stiffening member 802. As a result, the concave portions 840, 844 also can be viewed as secondary stiffening members that are located on opposed sides of the (primary) stiffening member 802, and that have thickness profiles that are different from or opposite to the primary stiffening member 802. In this illustrated example structure 800, the low heel and high toe areas 164, 162 tend to have increased flexibility as compared to the high heel and low toe areas 160, 166.

FIGS. 20 and 21 depict another embodiment of a ball striking face 900, in which the primary stiffening member 902 is similar to the primary stiffening member 402 of FIGS. 10 and 14, as described above (and may have the same thickness, angular, orientation, surface area coverage, and other features as described above for FIGS. 10 and 14). This example face 900 also has a textured or toothed structure formed on the inner surface 114 thereof. In the embodiment shown in FIGS. 20 and 21, the textured structure is formed by a plurality of substantially linear raised ribs or secondary stiffening members 904 arranged horizontally and vertically on the inner surface 114 to form a two-dimensional grid structure. The raised ribs 904 define indents 950 therebetween, and the grid structure forms rows and columns of indents 950 across the inner surface 114 of the face 900. As shown in FIG. 21, the rising and falling sides 952 of the ribs 904 are sloped, so that the indents 950 are formed in an inverse-pyramidal shape. In the embodiment illustrated, the textured structure is formed on both sides 954, 956 of the stiffening member 902 such that the entirety of the inner surface 114 of the face 900 is covered by the textured structure except for the portion occupied by the primary stiffening member 902. However, it is understood that in other embodiments, larger or smaller portions of the inner surface 114 may be occupied by the textured structure (e.g., up to 50%, up to 60%, up to 75%, or higher). In this embodiment, the textured structure provides increased stiffness to the occupied areas of the face 900, but less locally increased stiffness than at the locations corresponding to the stiffening member 902. In other embodiments, the face 900 may have a different textured structure, which may or may not be formed in a grid pattern and/or which may or may not be in the form of inverse pyramids. In one particular such embodiment, the structure is inverted from the structure of FIGS. 20 and 21, having a plurality of pyramid-shaped ribs or projections separated by a grid of horizontal and vertical linear recesses. In yet another embodiment, the ribs may be omitted and a side wall of an inverse-pyramidal shaped recess will extend upward to form a side wall of a pyramidal shaped projection.

Figure 22A:
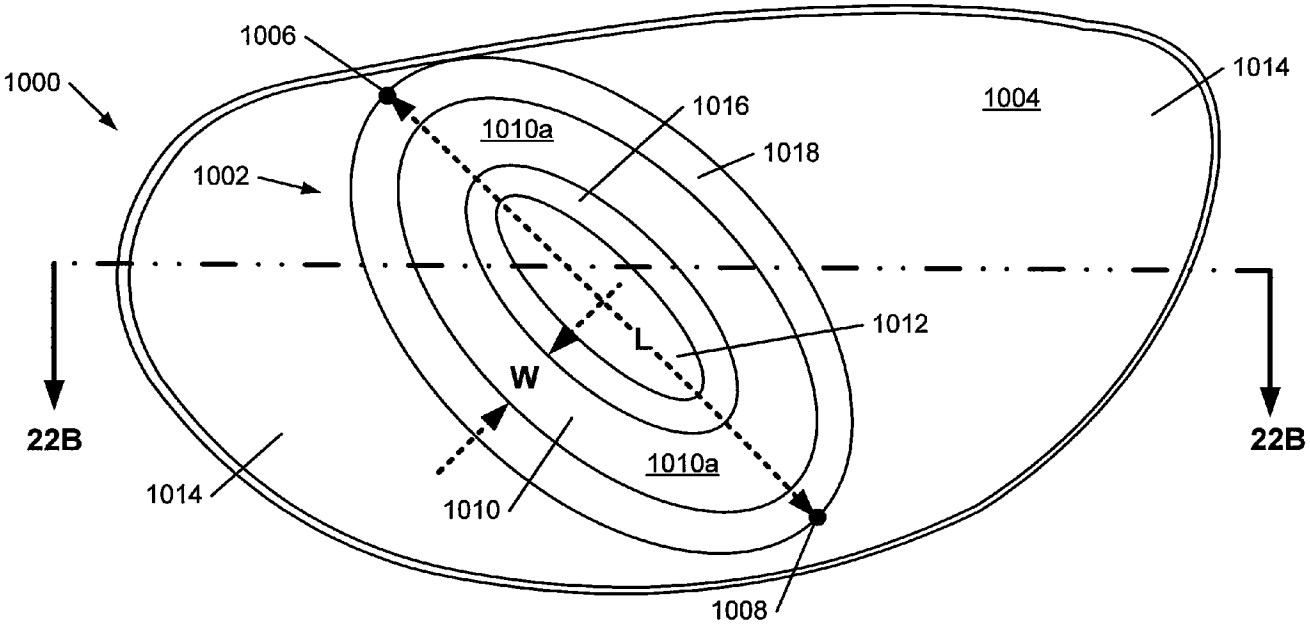
FIGS. 22A and 22B are rear and cross sectional views, respectively, of an eleventh embodiment of a face of a ball-striking device.
Figure 22B:
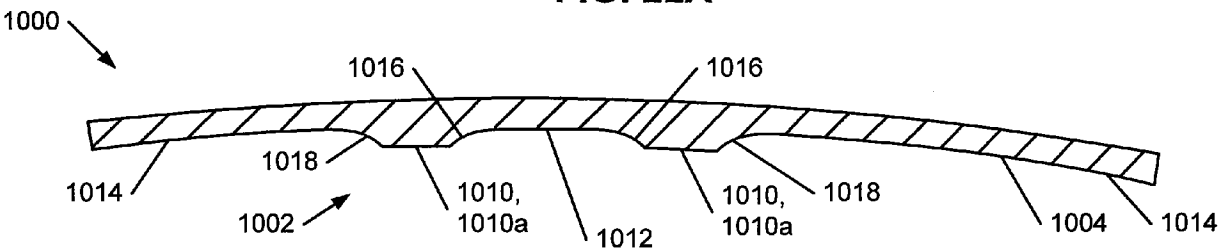

FIGS. 22A and 22B illustrate another golf club face structure 1000 in accordance with an example of this invention. As illustrated, an elongated stiffening member 1002 extends rearward from an inner surface 1004 of the face 1000 and across the inner surface 1004 of the face 1000 such that a central longitudinal axis of the stiffening member 1002 extends between a first point 1006 and a second point 1008. The first point 1006 in this examples structure 1000 is positioned in an upper heel quadrant of the face 1000, and the second point 1008 is positioned in or toward the lower toe quadrant of the face 1000 from the first point 1006. In the same manner as described above, the stiffening member 1002 provides locally increased stiffness to the face 1000. The stiffening member 1002 may be integrally formed as part of the face 1000 or it may be a separate element that is engaged with the face 1000.

In this illustrated example structure 1000, the stiffening member 1002 includes an annular ring 1010 surrounding an enclosed internal area 1012. The annular ring 1010 may be of any desired shape without departing from this invention, including, for example, round, oval, elliptical, polygon shaped (e.g., with 3 to 30 sides), etc. The overall width W of the ring 1010 may be constant or may change somewhat over its circumferential length (e.g., in the range from 1 mm to 10 mm, and in some examples, from 2 mm to 8 mm wide (e.g., in a direction generally parallel to the face).

The various parts of the face 1000 may have any desired thicknesses (in the direction away from the rear surface 1004 of the face 1000) without departing from this invention. In the illustrated embodiment, the thickest portion of the annular ring 1010 may be about 4 mm thick, and the internal area 1012 may be about 2.7 mm thick. The area 1014 around and outside of the annular ring 1010 may be about 2.3 mm thick in this illustrated embodiment. Furthermore, this illustrated stiffening member 1002 includes a first transition region 1016, e.g., that slopes between a top surface 1010*a* of the annular ring 1010 and the internal area 1012, and a second transition region 1018, e.g., that slopes between the top surface 1010*a* and the external area 1014. While the illustrated transition regions 1016 and 1018 are substantially straight sloped regions (see FIG. 22B), these regions 1016 and 1018 may be stepped, stepped or sloped at different rates or angles, curved, etc., without departing from this invention.

The specific dimensions and characteristics described above are simply examples. In accordance with at least some examples of this invention, the annular ring 1010 will be thicker than the enclosed internal area 1012, and the enclosed internal area 1012 may be thicker than or the same thickness as the external area 1014. Also, the thicknesses of these various areas 1010, 1012, and 1014 may be constant, substantially constant, or variable over the full extent of their respective areas. As some more specific examples, the annular ring 1010 may be from 2-8 mm thick, and in some examples from 2.5-6 mm thick; the internal area 1012 may be from 1-6 mm thick, and in some examples from 1.5-4 mm thick; and the external area 1014 may be from 1-6 mm thick, and in some examples from 1.5-4 mm thick. These thicknesses are measured as total thicknesses through the face at the specified locations.

The various areas 1010, 1012, 1014, 1016, and 1018 may occupy any desired percentage of the overall face surface area of the face without departing from this invention. The following table sets forth some potential ranges of surface area for these various areas:

| Region | Surface Area Range (%) | Surface Area Range (%) | Surface Area Range (%) |
|---|---|---|---|
| 1010 | 5-30% | 5-25% | 5-20% |
| 1012 | 5-40% | 10-35% | 15-35% |
| 1014 | 20-90% | 25-80% | 30-75% |
| 1016 | 1-25% | 2-20% | 2-20% |
| 1018 | 1-25% | 2-20% | 2-20% |

The overall face may have any desired area, and for drivers, this area may be at least about 4.8 $in^2$, and in some examples, in the range between 4.8 $in^2$ and 10 $in^2$, and in some examples, between 5 $in^2$ and 8 $in^2$.

The stiffening member 1002 may be of any desired longitudinal length L (e.g., from the first point 1006 to the second point 1008) and located at any desired position on the golf club face 1000 without departing from this invention. While the illustrated example structure 1000 shows the stiffening member 1002 extending in a slanted direction from the upper heel quadrant to or toward the lower toe quadrant, other arrangements are possible, including from the lower heel quadrant to the upper toe quadrant. Also, the stiffening member 1002 may be located at any desired position along the face in the heel-to-toe direction, including closer to the heel or closer to the toe than illustrated in FIG. 22A. The stiffening member 1002 also may extend at any desired angle without departing from this invention, including, for example, at an angle of from 10-80 degrees from horizontal, and in some examples, from 20-70 degrees from horizontal or even from 30-60 degrees from horizontal. Also, the stiffening member 1002 need not extend completely from the top surface of the face 1000 to the bottom surface of the face 1000, although it may extend this entire distance, if desired. In some example structures, the stiffening member 1002 will extend from 50-100% of the distance from the top surface of the face 1000 to the bottom surface of the face 1000, and it may span 60-95% or even 70-90% of this distance.

Figure 23A:
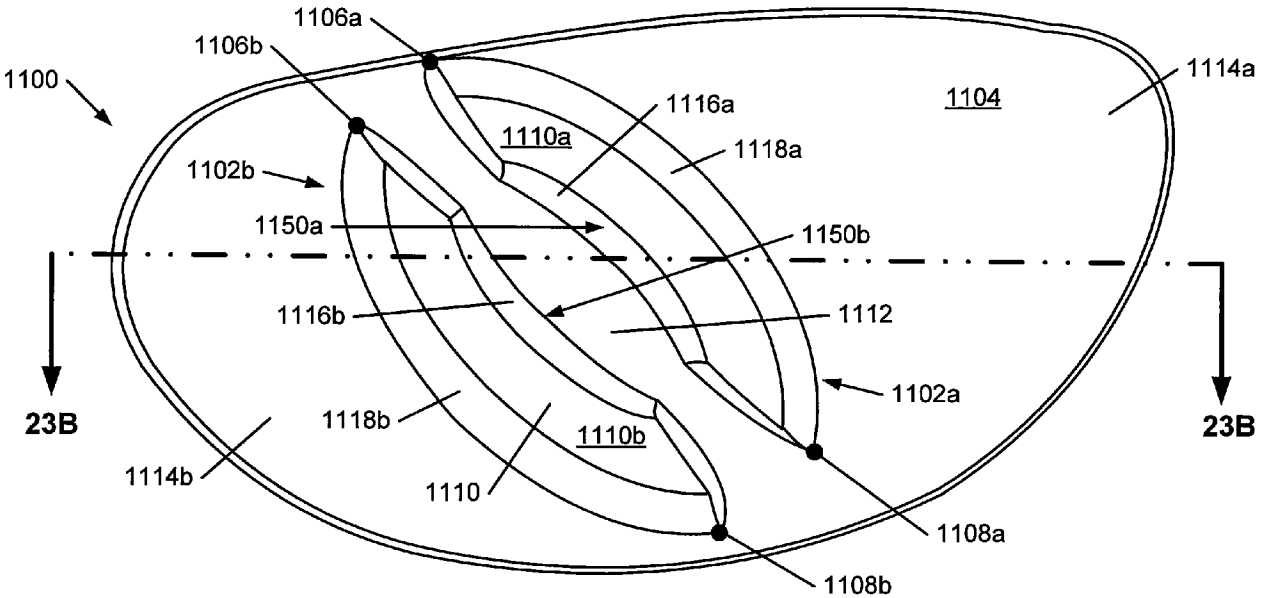
FIGS. 23A and 23B are rear and cross sectional views, respectively, of a twelfth embodiment of a face of a ball-striking device.
Figure 23B:
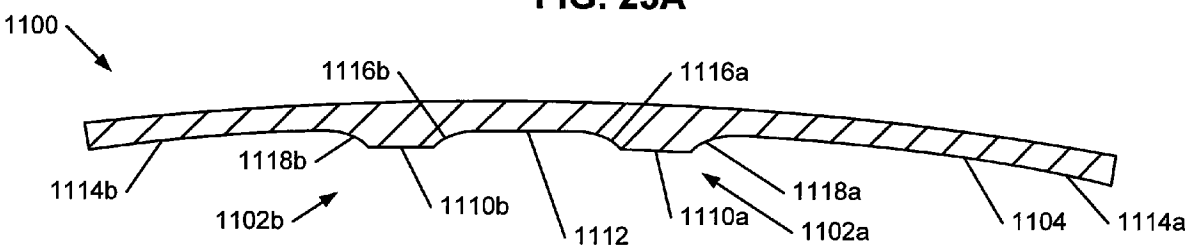

FIGS. 23A and 23B illustrate still another example face member 1100 in accordance with this invention. In this illustrated face member 1100, the overall stiffening member is similarly shaped to that illustrated in FIGS. 22A and 22B, but it is made from two separated portions, namely, first stiffening member 1102*a* and second stiffening member 1102*b*. The first stiffening member 1102*a* extends rearward from an inner surface 1104 of the face 1100 and across the inner surface 1104 of the face 1100 from a first location 1106*a* to a second location 1108*a*. The first location 1106*a* is positioned in an upper heel quadrant of the face 1100, and the second location 1108*a* is positioned in or toward the lower toe quadrant of the face 1100 from the first location 1106*a*. As illustrated, the first stiffening member 1102*a* includes a top surface 1110*a* and an inwardly curved surface 1150*a* that faces the heel of the club. Furthermore, in this example structure 1100, the second stiffening member 1102*b* extends rearward from the inner surface 1104 of the face 1100 and across the inner surface 1104 of the face 1100 from a third location 1106*b* to a fourth location 1108*b*. The third location 1106*b* is positioned in the upper heel quadrant of the face 1106*b* and the fourth location 1108*b* may be located, for example, in the lower toe or lower heel quadrants. The second stiffening member 1102*b* includes a top surface 1110*b* and an inwardly curved surface 1150*b* that faces the toe of the club. If desired, the first stiffening member 1102*a* and the second stiffening member 1102*b* may be mirror images of one another, although this is not a requirement.

If desired, the curved surfaces 1150*a* and 1150*b* of the first and second stiffening members 1102*a* and 1102*b* may face one another to define an internal area 1112 between the stiffening members 1102*a* and 1102*b*. Furthermore, as illustrated in FIGS. 23A and 23B, the first stiffening member 1102*a* may include a first sloped transition region 1116*a* extending from the top surface 1110*a* of the first stiffening member 1102*a* to the internal area 1112, and the second stiffening member 1102*b* may include a second sloped transition region 1116*b* extending from the top surface 1110*b* of the second stiffening member 1102*b* to the internal area 1112. Similarly, the first stiffening member 1102*a* further may include a third sloped transition region 1118*a* extending from the top surface 1110*a* of the first stiffening member 1102*a* to an area 1114*a* external to the first stiffening member 1102*a* and external to the internal area 1112, and the second stiffening member 1102*b* further may include a fourth sloped transition region 1118*b* extending from the top surface 1110*b* of the second stiffening member 1102*a* to an area 1114*b* external to the second stiffening member 1102*b* and external to the internal area 1112. Instead of being sloped, the transition regions 1116*a*, 1116*b*, 1118*a*, and/or 1118*b* may be stepped, curved, or otherwise shaped.

The various regions 1110*a*, 1110*b*, 1112, 1114*a*, 1114*b*, 1116*a*, 1116*b*, 1118*a*, and 1118*b* may have any desired thicknesses without departing from this invention, including the thickness ranges for the various corresponding areas described above for FIGS. 22A and 22B. The various regions 1110*a*, 1110*b*, 1112, 1114*a*, 1114*b*, 1116*a*, 1116*b*, 1118*a*, and 1118*b* also may occupy any desired percentage of the overall face surface area without departing from this invention. The following table sets forth some potential ranges of surface area for these various areas:

| Region | Surface Area Range (%) | Surface Area Range (%) | Surface Area Range (%) |
|---|---|---|---|
| 1110a | 2.5-15% | 2.5-12.5% | 2.5-10% |
| 1110b | 2.5-15% | 2.5-12.5% | 2.5-10% |
| 1112 | 5-40% | 10-35% | 15-35% |
| 1114a | 10-45% | 12.5-40% | 15-37.5% |
| 1114b | 10-45% | 12.5-40% | 15-37.5% |
| 1116a | 0.5-12.5% | 1-10% | 1-10% |
| 1116b | 0.5-12.5% | 1-10% | 1-10% |
| 1118a | 0.5-12.5% | 1-10% | 1-10% |
| 1018b | 0.5-12.5% | 1-10% | 1-10% |

The overall face may have any desired area, and for drivers, this area may be at least about 4.8 $in^2$, and in some examples, in the range between 4.8 $in^2$ and 10 $in^2$, and in some examples, between 5 $in^2$ and 8 $in^2$.

The stiffening members 1102*a* and 1102*b* may be of any desired length (e.g., from points 1106*a* and 1106*b* to 1108*a* and 1108*b*, respectively) and located at any desired positions on the golf club face 1100 without departing from this invention. While the illustrated example structure 1100 shows the stiffening members 1102*a* and 1102*b* combined to form an overall slanted stiffening member structure 1102 from the upper heel quadrant toward the lower toe quadrant, other arrangements are possible, including from the lower heel quadrant to the upper toe quadrant. Also, the stiffening members 1102*a* and 1102*b* may be located at any desired positions along the face in the heel-to-toe direction, separated by any desired distance, including closer to the heel and/or closer to the toe than illustrated in FIG. 23A. The stiffening members 1102*a* and/or 1102*b* also may extend at any desired angles without departing from this invention, including, for example, at angles of from 10-80 degrees from horizontal, and in some examples, from 20-70 degrees from horizontal or even from 30-60 degrees from horizontal. Also, the stiffening members 1102*a* and/or 1102*b* need not extend completely from the top surface of the face 1100 to the bottom surface of the face 1100, although they may extend this entire distance, if desired. In some example structures, the stiffening members 1102*a* and/or 1102*b* will extend from 50-100% of the distance from the top surface of the face 1100 to the bottom surface of the face 1100, and it may span 60-95% or even 70-90% of this distance.

It is understood that the ball striking faces 200, et seq. described herein may have additional features affecting the flexibility of the face or areas thereof. For example, the faces 200, et seq. may have additional areas of relatively increased or decreased face thickness. Additionally, the faces 200, et seq. described herein may contain a greater or smaller number of stiffening members, and may contain multiple "primary" stiffening members (as described herein), creating additional areas of relative stiffness and flexibility. It is contemplated that in the embodiments described above with multiple stiffening members, various ones of the stiffening members may be formed of different materials or may be strengthened or otherwise designed with specific properties through processing techniques.

Heads 102 incorporating the faces 200, et seq. disclosed herein may be used as a ball striking device or a part thereof. For example, a golf club 100 as shown in FIG. 1 may be manufactured by attaching a shaft or handle 104 to the head 102, as described above. In other embodiments, different types of ball striking devices can be manufactured according to the principles described herein.

The ball striking devices and heads therefor as described herein provide many benefits and advantages over existing products. For example, the stiffening members can be strategically located and designed to provide local stiffness and flexibility in the face of the head so that certain areas of the face will have a COR that is higher than other areas, without exceeding COR limits set by regulatory authorities. The head can be configured so that the areas of the face that most frequently impact the ball during play will have a higher COR. A ball impacting these specific locations on the face will have more energy and velocity transferred to it, thus resulting in longer hits.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A golf club head comprising:

a face configured for striking a ball with an outer surface thereof;

a body connected to the face; and a stiffening member connected to an inner surface of the face at a first contact location and a second contact location, the stiffening member comprising a first leg connected to the face and extending substantially perpendicular to the face at the first contact location, a second leg connected to the face and extending substantially perpendicular to the face at the second contact location, and an arm extending between the first and second legs, the arm being spaced from the inner surface of the face, wherein the stiffening member provides locally increased stiffness to the face such that areas of the face surrounding the first and second contact locations have locally greater stiffness relative to other areas of the face spaced from the contact locations, and wherein the stiffening member further comprises a third leg connected to the inner surface of the face and extending substantially perpendicular to the face at a third contact location, wherein the arm extends to each of the first, second, and third contact locations and connects the first, second, and third contact locations to one another.

2. The golf club head of claim 1, wherein the arm of the stiffening member comprises a plurality of arm segments connected to form a Y-shape.

3. The golf club head of claim 1, wherein the body is adapted for connection of a shaft proximate a heel of the body and having a toe opposite the heel, wherein the first contact location is positioned in an upper heel quadrant of the face, and the second contact location is positioned toward a lower toe quadrant of the face with respect to the first contact location.

4. The golf club head of claim 1, wherein the body is adapted for connection of a shaft proximate a heel of the body and having a toe opposite the heel, wherein the first contact location is positioned in an upper toe quadrant of the face, and the second contact location is positioned toward a lower heel quadrant of the face with respect to the first contact location.

5. A golf club comprising the golf club head of claim 1 and a shaft engaged with the head.

6. A golf club head comprising:

a face configured for striking a ball with an outer surface thereof;

a body connected to the face, the body adapted for connection of a shaft proximate a heel of the body and having a toe opposite the heel; and an elongated stiffening member extending rearward from an inner surface of the face and extending across the inner surface of the face such that a central longitudinal axis of the stiffening member extends between a first point and a second point, the first point positioned in an upper heel quadrant of the face, and the second point is positioned toward the lower toe quadrant of the face with respect to the first point, the stiffening member providing locally increased stiffness to the face, wherein the stiffening member includes an annular ring surrounding an enclosed internal area, wherein the annular ring is thicker than the enclosed internal area.

7. The golf club head of claim 6, wherein the stiffening member further includes a sloped transition region extending between the annular ring and the enclosed internal area.

8. The golf club head of claim 6, wherein the stiffening member further includes a sloped transition region extending between the annular ring and an area external to the annular ring.

9. The golf club head of claim 8, wherein the enclosed internal area is thicker than the area external to the annular ring.

10. The golf club head of claim 6, wherein the annular ring is elliptical or oval shaped.

11. A golf club comprising the golf club head of claim 6 and the shaft engaged with the head.

12. A golf club head comprising:

a face configured for striking a ball with an outer surface thereof;

a body connected to the face, the body adapted for connection of a shaft proximate a heel of the body and having a toe opposite the heel;

a first stiffening member extending rearward from an inner surface of the face and extending across the inner surface of the face from a first location to a second location, the first location positioned in an upper heel quadrant of the face, and the second location is positioned toward the lower toe quadrant of the face with respect to the first location, the first stiffening member providing locally increased stiffness to the face, and wherein the first stiffening member includes a curved surface that faces the heel; and a second stiffening member extending rearward from the inner surface of the face and extending across the inner surface of the face from a third location to a fourth location, the third location positioned in an upper heel quadrant of the face, and wherein the second stiffening member includes a curved surface that faces the toe.

13. The golf club head of claim 12, wherein the curved surfaces of the first stiffening member and the second stiffening member face one another to define an internal area between the stiffening members.

14. The golf club head of claim 13, wherein the first stiffening member includes a first sloped transition region extending from a top surface of the first stiffening member to the internal area, and wherein the second stiffening member includes a second sloped transition region extending from a top surface of the second stiffening member to the internal area.

15. The golf club head of claim 14, wherein the first stiffening member further includes a third sloped transition region extending from the top surface of the first stiffening member to an area external to the first stiffening member and external to the internal area, and wherein the second stiffening member further includes a fourth sloped transition region extending from the top surface of the second stiffening member to an area external to the second stiffening member and external to the internal area.

16. The golf club head of claim 15, wherein the areas external to the first and second stiffening member and external to the internal area is thinner than the internal area.

17. The golf club head of claim 12, wherein the fourth location is positioned in the lower toe quadrant of the face.

18. The golf club head of claim 12, wherein the second stiffening member is a mirror image of the first stiffening member.

19. A golf club comprising the golf club head of claim 12 and the shaft engaged with the head.

20. A golf club head comprising:

a face configured for striking a ball with an outer surface thereof;

a body connected to the face; and a stiffening member connected to an inner surface of the face at a first contact location and a second contact location, the stiffening member comprising a first leg connected to the face and extending substantially perpendicular to the face at the first contact location, a second leg connected to the face and extending substantially perpendicular to the face at the second contact location, and an arm extending between the first and second legs, the arm being spaced from the inner surface of the face, wherein the stiffening member provides locally increased stiffness to the face such that areas of the face surrounding the first and second contact locations have locally greater stiffness relative to other areas of the face spaced from the contact locations, and wherein the body is adapted for connection of a shaft proximate a heel of the body and having a toe opposite the heel, wherein the first contact location is positioned in an upper heel quadrant of the face, and the second contact location is positioned toward a lower toe quadrant of the face with respect to the first contact location.

21. A golf club comprising the golf club head of claim 20, having the shaft engaged with the body of the head.

22. A golf club head comprising:

a face configured for striking a ball with an outer surface thereof;

a body connected to the face; and a stiffening member connected to an inner surface of the face at a first contact location and a second contact location, the stiffening member comprising a first leg connected to the face and extending substantially perpendicular to the face at the first contact location, a second leg connected to the face and extending substantially perpendicular to the face at the second contact location, and an arm extending between the first and second legs, the arm being spaced from the inner surface of the face, wherein the stiffening member provides locally increased stiffness to the face such that areas of the face surrounding the first and second contact locations have locally greater stiffness relative to other areas of the face spaced from the contact locations, and wherein the body is adapted for connection of a shaft proximate a heel of the body and having a toe opposite the heel, wherein the first contact location is positioned in an upper toe quadrant of the face, and the second contact location is positioned toward a lower heel quadrant of the face with respect to the first contact location.

23. A golf club comprising the golf club head of claim 22, having the shaft engaged with the body of the head.

* * * * *